US011729548B2

(12) United States Patent
Iida et al.

(10) Patent No.: US 11,729,548 B2
(45) Date of Patent: Aug. 15, 2023

(54) AUDIO PROCESSING APPARATUS, CONTROL METHOD, AND STORAGE MEDIUM, EACH FOR PERFORMING NOISE REDUCTION USING AUDIO SIGNALS INPUT FROM PLURALITY OF MICROPHONES

(71) Applicant: CANON KABUSHIKI KAISHA, Tokyo (JP)

(72) Inventors: Yoshinobu Iida, Tokyo (JP); Aoi Hashiguchi, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 21 days.

(21) Appl. No.: 17/410,592

(22) Filed: Aug. 24, 2021

(65) Prior Publication Data

US 2022/0070580 A1 Mar. 3, 2022

(30) Foreign Application Priority Data

Aug. 27, 2020 (JP) ..... 2020-143203
Aug. 27, 2020 (JP) ..... 2020-143205
Sep. 25, 2020 (JP) ..... 2020-161435

(51) Int. Cl.
*H04R 3/00* (2006.01)

(52) U.S. Cl.
CPC ..... *H04R 3/00* (2013.01); *H04R 3/005* (2013.01); *H04R 2410/05* (2013.01)

(58) Field of Classification Search
CPC ..... H04R 3/00; H04R 2410/05; H04R 3/005; H04R 1/02; G10L 2021/02165; G10L 21/0232; H03G 3/32
USPC ..... 381/26, 57, 91, 92, 122, 94.1–94.9
See application file for complete search history.

(56) References Cited

U.S. PATENT DOCUMENTS 6,639,986 B2 * 10/2003 Kanamori ..... H04R 3/005 381/71.1
8,867,773 B2 * 10/2014 Kimura ..... H04N 5/225 381/361
9,412,353 B2 * 8/2016 Rhee ..... G10L 21/0216
9,736,578 B2 * 8/2017 Iyengar ..... H04R 3/005
(Continued)

FOREIGN PATENT DOCUMENTS

JP 2011-114465 A 6/2011
JP 2011205527 A 10/2011

*Primary Examiner* — Xu Mei
(74) *Attorney, Agent, or Firm* — Canon U.S.A., Inc. IP Division

(57) ABSTRACT

An audio processing apparatus includes an attachment unit for a lens including a noise source, a first microphone for ambient sound, a second microphone for sound occurring from the noise source, a first conversion unit for Fourier transform of an audio signal output from the first microphone to generate a first audio signal, a second conversion unit for Fourier transform of an audio signal output from the second microphone to generate a second audio signal, a generation unit which generates noise data using the second audio signal and a parameter concerned with noise of the noise source, a subtraction unit which subtracts the noise data from the first audio signal, and a third conversion unit which performs inverse Fourier transform of an audio signal output from the subtraction unit. The generation unit uses, as the parameter, a parameter associated with a type of the lens attached to the attachment unit.

20 Claims, 20 Drawing Sheets

(56) References Cited

U.S. PATENT DOCUMENTS

| | | | | |
|---|---|---|---|---|
| 10,327,070 | B2 * | 6/2019 | Ohtsuka | H04R 1/1083 |
| 2009/0175466 | A1 * | 7/2009 | Elko | H04R 25/407 381/94.1 |
| 2015/0281834 | A1 * | 10/2015 | Takano | H04R 1/326 381/92 |
| 2019/0057711 | A1 * | 2/2019 | Toriumi | G10L 21/0232 |
| 2022/0068250 | A1 * | 3/2022 | Tsujimoto | G10K 11/178 |

* cited by examiner

FIG.5

| NAME | TYPE OF NOISE | [0] | [1] | [2] | | [N-1] | [N] | [N+1] | | [511] | [512] |
|---|---|---|---|---|---|---|---|---|---|---|---|
| PL1 | WHITE NOISE | 0 | 0 | 0 | ··· | 0.20 | 0.18 | 0.21 | ··· | 0 | 0 |
| PL2 | SHORT-TERM NOISE | 0 | 0 | 0 | ··· | 0.85 | 0.86 | 0.88 | ··· | 0 | 0 |
| PL3 | LONG-TERM NOISE | 0 | 0 | 0 | ··· | 0.80 | 0.79 | 0.85 | ··· | 0 | 0 |
| | ⋮ | | | | | | | | | | |
| PLx | OTHER NOISE | 0 | 0 | 0 | ··· | 0.61 | 0.78 | 0.90 | ··· | 0 | 0 |
| PR1 | WHITE NOISE | 0 | 0 | 0 | ··· | 0.20 | 0.17 | 0.22 | ··· | 0 | 0 |
| PR2 | SHORT-TERM NOISE | 0 | 0 | 0 | ··· | 0.85 | 0.86 | 0.88 | ··· | 0 | 0 |
| PR3 | LONG-TERM NOISE | 0 | 0 | 0 | ··· | 0.81 | 0.78 | 0.86 | ··· | 0 | 0 |
| | ⋮ | | | | | | | | | | |
| PRx | OTHER NOISE | 0 | 0 | 0 | ··· | 0.66 | 0.81 | 0.88 | ··· | 0 | 0 |

Lch_Before[N]

Nch_Before[N]

PLx[N]

Lch_Before[N]

Nch_Before[N]

NL[N]

Lch_After[N]

LENS CONTROL SIGNAL
High
Low
t701
t702
t703
t704
t705
t706
t707
t708

Lch_Before[n]
X
Y

LEVEL OF AMBIENT SOUND
Th2
Th1

Nch_Before[n]

Ndiff[n]
Th_Ndiff[n]
LEVEL 1
LEVEL 2
LEVEL 3

Nint[n]
Th_Nint[n]
LEVEL 1
LEVEL 2
LEVEL 3

NOISE PARAMETERS
ONLY PL1
PL1 + PL2
PL1 + PL3

NL[n]

Lch_After[n]

FIG.10

| LENS NAME | PL2[0] | PL2[1] | PL2[2] | | PL2[N-1] | PL2[N] | PL2[N+1] | | PL2[512] |
|---|---|---|---|---|---|---|---|---|---|
| DEFAULT VALUE | 0 | 0 | 0 | | 0.85 | 0.86 | 0.88 | | 0 |
| LENS A | 0 | 0 | 0 | | 0.82 | 0.85 | 0.90 | | 0 |
| LENS B | 0 | 0 | 0 | ... | 0.78 | 0.77 | 0.80 | ... | 0 |
| ⋮ | | | | | | | | | |
| | | | | | | | | | |

| LENS NAME | PR2[0] | PR2[1] | PR2[2] | | PR2[N-1] | PR2[N] | PR2[N+1] | | PR2[512] |
|---|---|---|---|---|---|---|---|---|---|
| DEFAULT VALUE | 0 | 0 | 0 | | 0.85 | 0.86 | 0.88 | | 0 |
| LENS A | 0 | 0 | 0 | | 0.81 | 0.85 | 0.89 | | 0 |
| LENS B | 0 | 0 | 0 | ... | 0.78 | 0.77 | 0.81 | ... | 0 |
| ⋮ | | | | | | | | | |
| | | | | | | | | | |

Lch_Before[N]

Nch_Before[N]

NL[N]

Lch_After[N]

Lch_Before[N]

Nch_Before[N]

FIG.15

| ANGLE | COR[400] | COR[401] | | COR[449] | COR[450] |
|---|---|---|---|---|---|
| 60° TO 90° (RANGE a) | 0.49 | 0.50 | | 0.86 | 0.88 |
| 30° TO 60° (RANGE b) | 0.56 | 0.54 | | 0.81 | 0.85 |
| -30° TO 30° (RANGE c) | 0.50 | 0.52 | ... | 0.77 | 0.80 |
| -60° TO -30° (RANGE d) | 0.48 | 0.50 | | 0.77 | 0.78 |
| -90° TO -60° (RANGE e) | 0.44 | 0.45 | | 0.68 | 0.72 |

Lch_Before[N]
AMPLITUDE
FIVE MAGNIFICATIONS
ONE MAGNIFICATION
C
C'
0
200
250
512
N Nch_Before[N]
D
D'

FIG.18

| ZOOM MAGNIFICATION | COR[200] | COR[201] | | COR[249] | COR[250] |
|---|---|---|---|---|---|
| ONE TO TWO MAGNIFICATIONS | 0.66 | 0.68 | | 0.84 | 0.90 |
| TWO TO THREE MAGNIFICATIONS | 0.65 | 0.67 | | 0.83 | 0.88 |
| THREE TO FOUR MAGNIFICATIONS | 0.64 | 0.66 | ... | 0.80 | 0.85 |
| FOUR TO FIVE MAGNIFICATIONS | 0.62 | 0.65 | | 0.78 | 0.82 |

AUDIO PROCESSING APPARATUS, CONTROL METHOD, AND STORAGE MEDIUM, EACH FOR PERFORMING NOISE REDUCTION USING AUDIO SIGNALS INPUT FROM PLURALITY OF MICROPHONES

BACKGROUND

Field of Disclosure

Aspects of the present invention generally relate to an audio processing apparatus capable of reducing noise included in audio data.

Description of the Related Art

A digital camera, which is an example of an audio processing apparatus, is capable of, when recording moving image data, also recording ambient sound along with the moving image data. Moreover, the digital camera has an autofocus function, which adjusts focus to a subject during recording of moving image data by driving an optical lens. Moreover, the digital camera has a function which performs zoom by driving an optical lens during recording of a moving image.

When, in this way, the optical lens is driven during recording of a moving image, drive sound of the optical lens may sometimes be included as noise in sound which is to be recorded along with the moving image. Therefore, a conventional digital camera is capable of, when picking up, as noise, for example, sliding sound which occurs during driving of an optical lens, recording ambient sound while reducing the occurring noise. Japanese Patent Application Laid-Open No. 2011-205527 discusses a digital camera which reduces noise using a spectral subtraction method.

However, the digital camera discussed in Japanese Patent Application Laid-Open No. 2011-205527 generates a noise pattern from noise collected by a microphone which is used to record ambient sound, and, therefore, may not be able to acquire a correct noise pattern from sliding sound which occurs within a housing of the optical lens. In this case, the digital camera may not be able to effectively reduce noise included in the collected sound.

SUMMARY

According to an aspect of the present disclosure, an audio processing apparatus includes an attachment unit configured to attach a lens including a noise source, a first microphone configured to acquire ambient sound, a second microphone configured to acquire sound occurring from the noise source, a first conversion unit configured to perform Fourier transform of an audio signal output from the first microphone to generate a first audio signal, a second conversion unit configured to perform Fourier transform of an audio signal output from the second microphone to generate a second audio signal, a generation unit configured to generate noise data using the second audio signal and a parameter concerned with noise of the noise source, a subtraction unit configured to subtract the noise data from the first audio signal, and a third conversion unit configured to perform inverse Fourier transform of an audio signal output from the subtraction unit, wherein the generation unit uses, as the parameter, a parameter associated with a type of the lens attached to the attachment unit.

Further features of the present disclosure will become apparent from the following description of exemplary embodiments with reference to the attached drawings.

BRIEF DESCRIPTION OF THE DRAWINGS

FIG. 5 is a diagram illustrating noise parameters in the first exemplary embodiment.

FIG. 10 is a diagram illustrating noise parameters for respective lenses in the first exemplary embodiment.

FIG. 15 is a diagram illustrating corrective noise parameters for respective pieces of orientation information about the imaging apparatus in the second exemplary embodiment.

FIG. 18 is a diagram illustrating corrective noise parameters for respective zoom magnifications of the imaging apparatus in the second exemplary embodiment.

DESCRIPTION OF THE EMBODIMENTS

Various exemplary embodiments, features, and aspects of the disclosure will be described in detail below with reference to the drawings.

<Outer Appearance Diagram of Imaging Apparatus 100>

Figure 1A:
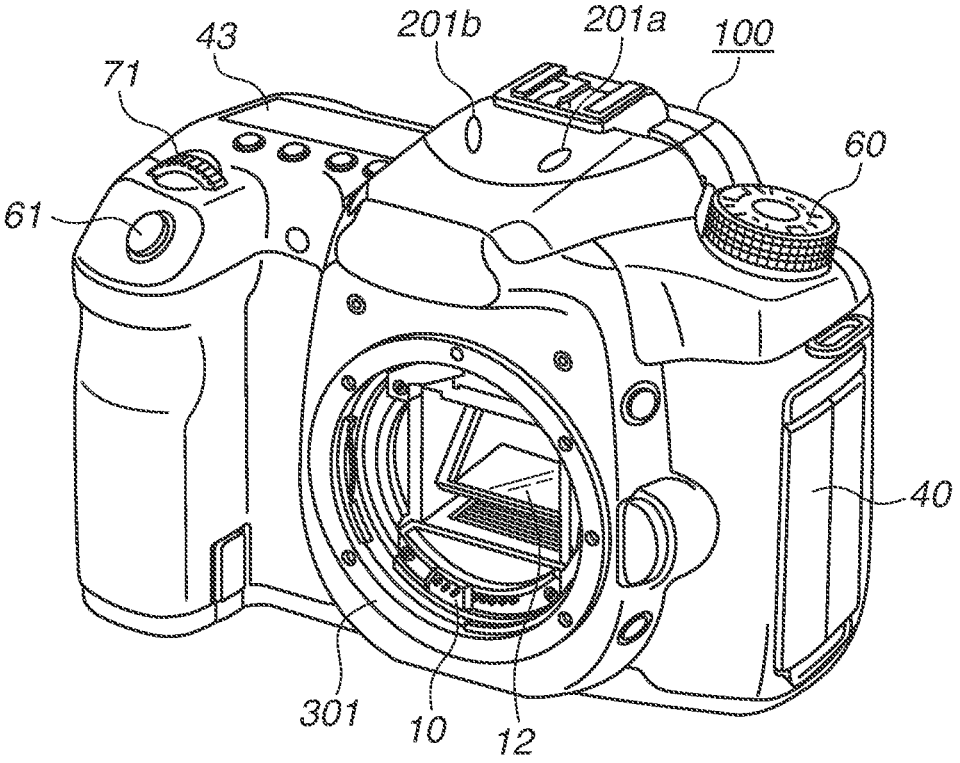
FIGS. 1A and 1B are perspective views of an imaging apparatus in a first exemplary embodiment.
Figure 1B:
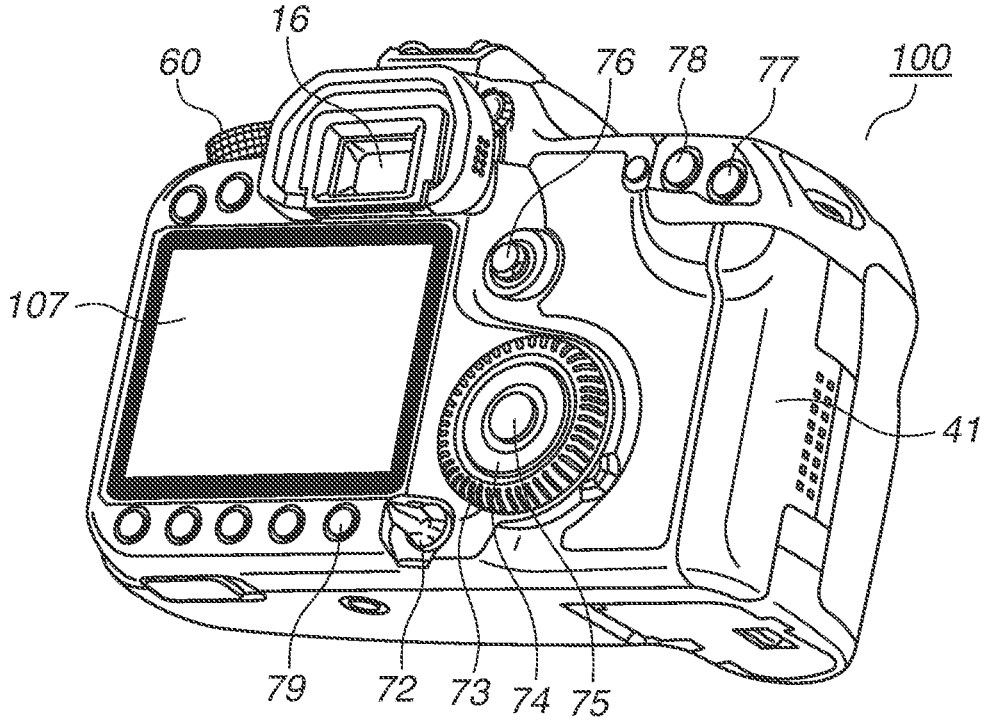

FIGS. 1A and 1B illustrate an example of an outer appearance diagram of an imaging apparatus 100, which serves as an example of an audio processing apparatus according to a first exemplary embodiment of the present disclosure. FIG. 1A is an example of a front side perspective view of the imaging apparatus 100. FIG. 1B is an example of a back side perspective view of the imaging apparatus 100. Referring to FIGS. 1A and 1B, an optical lens (not illustrated) is attached to a lens mount 301.

A display unit 107 displays, for example, image data and character information. The display unit 107 is provided on the back side of the imaging apparatus 100. An extra-viewfinder display unit 43 is a display unit provided on the upper surface of the imaging apparatus 100. The extra-viewfinder display unit 43 displays setting values of the imaging apparatus 100, such as a shutter speed and an aperture value. An eyepiece viewfinder 16 is a look-into type viewfinder. The user is able to confirm focusing and composition of an optical image of the subject by observing a focusing screen included in the eyepiece viewfinder 16.

Figure 2:
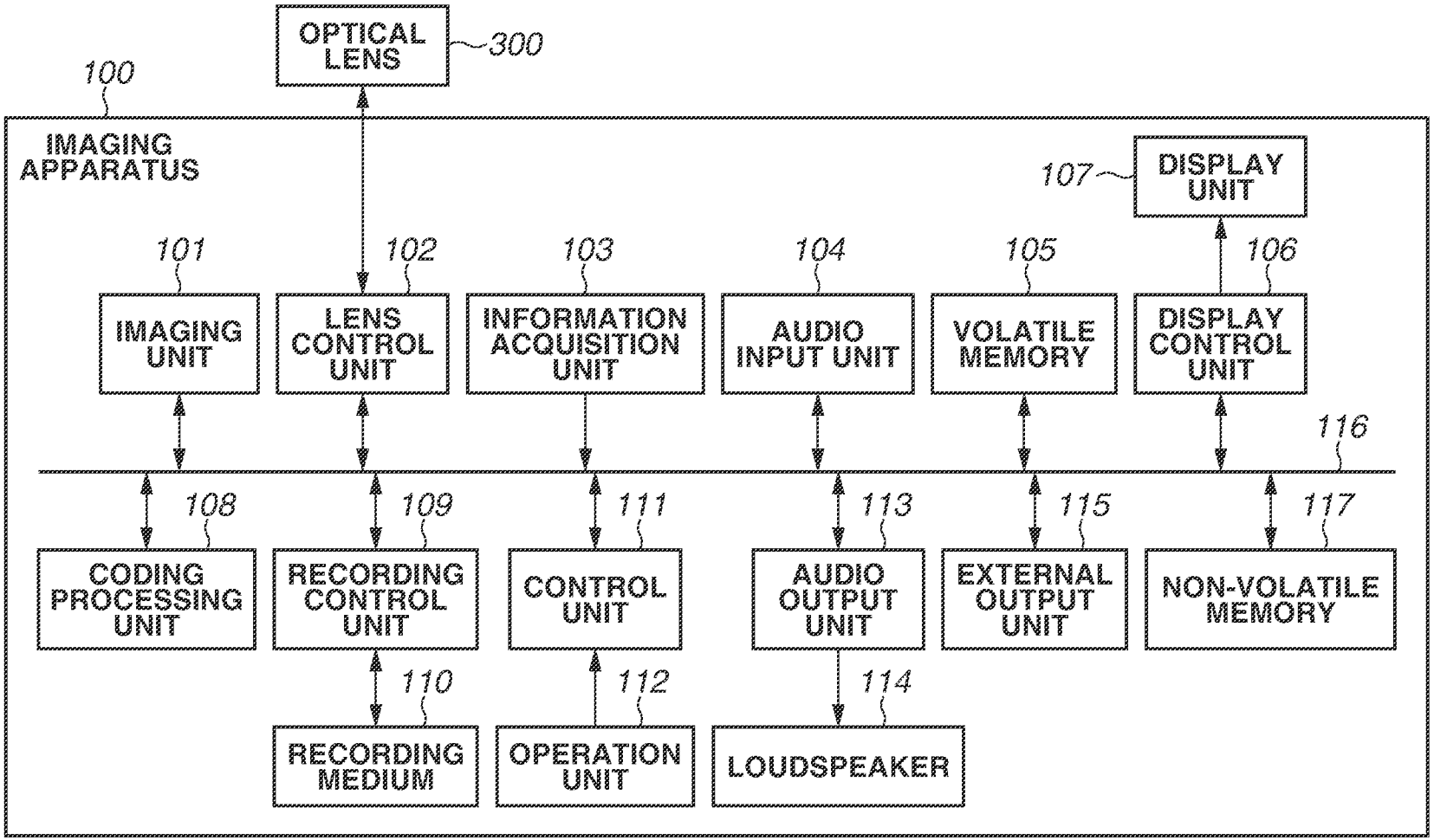
FIG. 2 is a block diagram illustrating a configuration of the imaging apparatus in the first exemplary embodiment.

A release switch 61 is an operation member used for the user to issue an image capturing instruction. A mode changeover switch 60 is an operation member used for the user to change over between various modes. A main electronic dial 71 is a rotary operation member. The user is able to change setting values of the imaging apparatus 100, such as a shutter speed and an aperture value, by rotating the main electronic dial 71. The release switch 61, the mode changeover switch 60, and the main electronic dial 71 are included in an operation unit 112 (FIG. 2).

A power switch 72 is an operation member used to power on and off the imaging apparatus 100. A sub-electronic dial 73 is a rotary operation member. The user is able to perform, for example, movement of a selection frame displayed on the display unit 107 and image feeding in a playback mode by rotating the sub-electronic dial 73. Arrow keys 74 are arrow keys (four directional keys) the upper, lower, left, and right portions of which are able to be individually pressed. The imaging apparatus 100 performs processing corresponding to the pressed portion (direction) of the arrow keys 74. The power switch 72, the sub-electronic dial 73, and the arrow keys 74 are included in the operation unit 112.

A SET button 75 is a push button. The SET button 75 is mainly used for the user to, for example, finalize a selection item displayed on the display unit 107. An LV button 76 is a button used to switch turning-on and turning-off of a live view (hereinafter referred to as "LV"). In a moving image recording mode, the LV button 76 is used to issue an instruction for starting and stopping moving image capturing (recording). An enlargement button 77 is a push button used to turn on and off an enlargement mode in live view displaying in the image capturing mode and perform changing of an enlargement ratio in the enlargement mode. The SET button 75, the LV button 76, and the enlargement button 77 are included in the operation unit 112.

In the playback mode, the enlargement button 77 functions as a button used to increase the enlargement ratio of image data displayed on the display unit 107. A reduction button 78 is a button used to decrease the enlargement ratio of image data displayed on the display unit 107. A playback button 79 is an operation button used to switch between the image capturing mode and the playback mode. When the playback button 79 is pressed during a period in which the imaging apparatus 100 is in the image capturing mode, the imaging apparatus 100 transitions to the playback mode, thus displaying image data recorded on a recording medium 110 (FIG. 2) on the display unit 107. The reduction button 78 and the playback button 79 are included in the operation unit 112.

A quick return mirror (instant return mirror) 12 (hereinafter referred to as a "mirror 12") is a mirror configured to switch a light flux having entered via an optical lens attached to the imaging apparatus 100 between falling on the side of the eyepiece viewfinder 16 and falling on the side of an imaging unit 101 (FIG. 2). The mirror 12 is moved up and down by an actuator (not illustrated) being controlled by a control unit 111 (FIG. 2) at the time of exposure, live view image capturing, and moving image capturing. The mirror 12 is located, in ordinary times, in such a way as to cause a light flux to fall on the eyepiece viewfinder 16. In the case of image capturing being performed and the case of live view display, the mirror 12 swings up (in a mirror-up manner) in such a way as to cause a light flux to fall on the imaging unit 101. Moreover, the mirror 12 has a central portion formed as a half-reflection mirror. A part of the light flux having passed through the central portion of the mirror 12 falls on a focus detection unit (not illustrated) configured for focus detection.

A communication terminal 10 is a communication terminal used for an optical lens 300 (FIG. 2) attached to the imaging apparatus 100 and the imaging apparatus 100 to communicate with each other. A terminal cover 40 is a cover which protects connectors (not illustrated), such as connection cables, interconnecting connection cables for an external apparatus and the imaging apparatus 100. A lid 41 is a lid on a slot in which a recording medium 110 (FIG. 2) is housed. A lens mount 301 is a mounting portion to which the optical lens 300 is mountable.

An L microphone 201*a* and an R microphone 201*b* are microphones configured to collect, for example, a voice of the user. As viewed from the back side of the imaging apparatus 100, the L microphone 201*a* is located on the left side and the R microphone 201*b* is located on the right side.

<Configuration of Imaging Apparatus 100>

FIG. 2 is a block diagram illustrating an example of a configuration of the imaging apparatus 100 in the first exemplary embodiment.

The optical lens 300 is a lens unit which is attachable to the imaging apparatus 100. For example, the optical lens 300 is a zoom lens or a variable focal length lens. The optical lens 300 includes an optical lens unit, a motor for driving the optical lens unit, and a communication unit for communicating with a lens control unit 102 of the imaging apparatus 100 described below. The optical lens 300 is able to perform focusing and zooming with respect to a subject and correction of image shake, by moving the optical lens unit with the motor based on a control signal received by the communication unit.

The imaging unit 101 includes an image sensor, which converts the optical image of a subject formed on an imaging plane via the optical lens 300 into an electrical signal, and an image processing unit, which generates still image data or moving image data from the electrical signal generated by the image sensor and outputs the generated still image data or moving image data. The image sensor is, for example, a charge-coupled device (CCD) sensor or a complementary metal-oxide semiconductor (CMOS) sensor. In the first exemplary embodiment, a series of processing for causing the imaging unit 101 to generate image data including still image data or moving image data and outputting the generated image data from the imaging unit 101 is referred to as "image capturing". In the imaging apparatus 100, image data is recorded on the recording medium 110 described below in compliance with the Design rule for Camera File system (DCF) standard.

The lens control unit 102 outputs a control signal to the optical lens 300 via the communication terminal 10 based on data output from the imaging unit 101 and a control signal output from the control unit 111 described below, thus controlling the optical lens 300. Moreover, the lens control unit 102 receives lens information from the optical lens 300 attached to the imaging apparatus 100. The lens information includes, for example, the type of a lens, the model number of a lens, and the type of a noise source.

An information acquisition unit 103 detects, for example, the inclination of the imaging apparatus 100 and the temperature within a housing of the imaging apparatus 100. For example, the information acquisition unit 103 detects the inclination of the imaging apparatus 100 with an acceleration sensor or a gyroscope sensor. Moreover, for example, the information acquisition unit 103 detects the temperature within a housing of the imaging apparatus 100 with a temperature sensor.

An audio input unit 104 generates audio data from sound acquired by the microphones. The audio input unit 104 acquires sound around the imaging apparatus 100 using the microphones, and performs analog-digital conversion (A/D conversion) and various audio processing operations on the acquired sound, thus generating audio data. In the first exemplary embodiment, the audio input unit 104 includes microphones. Details of a configuration example of the audio input unit 104 are described below.

A volatile memory 105 temporarily records thereon image data generated by the imaging unit 101 and audio data generated by the audio input unit 104. Moreover, the volatile memory 105 is also used as, for example, a temporary recording area for image data to be displayed on the display unit 107 and a work area for the control unit 111.

A display control unit 106 performs control to display, on the display unit 107, for example, image data output from the imaging unit 101, characters for interactive operations, and a menu screen. Moreover, the display control unit 106 performs control to sequentially display, on the display unit 107, digital data output from the imaging unit 101 during still image capturing and moving image capturing, thus enabling the display unit 107 to function as an electronic viewfinder. For example, the display unit 107 is a liquid crystal display or an organic electroluminescence (EL) display. Moreover, the display control unit 106 is also able to perform control to display, on an external display via an external output unit 115 described below, for example, still image data and moving image data output from the imaging unit 101, characters for interactive operations, and a menu screen.

A coding processing unit 108 is able to code each of image data and audio data temporarily recorded on the volatile memory 105. For example, the coding processing unit 108 is able to generate moving image data obtained by coding and data-compressing moving image data in conformity with the JPEG standard or RAW image format. For example, the coding processing unit 108 is able to generate moving image data obtained by coding and data-compressing moving image data in conformity with the MPEG2 standard or H.264/MPEG4-AVC standard. Moreover, for example, the coding processing unit 108 is able to generate audio data obtained by coding and data-compressing audio data in conformity with the Dolby AC-3 standard, the Advanced Audio Coding (AAC) standard, the Adaptive Transform Acoustic Coding (ATRAC) standard, or the adaptive differential pulse-code modulation (ADPCM) method. Moreover, the coding processing unit 108 can perform coding in such a way as not to data-compress audio data in conformity with, for example, the linear pulse-code modulation (LPCM) method.

A recording control unit 109 is able to record data on the recording medium 110 and read out data from the recording medium 110. For example, the recording control unit 109 is able to record still image data, moving image data, and audio data generated by the coding processing unit 108 on the recording medium 110, and read out still image data, moving image data, and audio data from the recording medium 110. Examples of the recording medium 110 include a Secure Digital (SD) card, a CompactFlash (CF) card, an XQD card, a hard disk drive (HDD) (magnetic disc), an optical disc, and a semiconductor memory. The recording medium 110 can be configured to be attachable to and detachable from the imaging apparatus 100 or can be incorporated in the imaging apparatus 100. Thus, the recording control unit 109 only needs to include at least a unit which accesses the recording medium 110.

The control unit 111 controls various components of the imaging apparatus 100 via a data bus 116 according to an input signal and a program described below. The control unit 111 includes a central processing unit (CPU), a read-only memory (ROM), and a random access memory (RAM) configured to perform various control operations. Furthermore, instead of the control unit 111 controlling the entire imaging apparatus 100, a plurality of pieces of hardware can be configured to control the entire imaging apparatus 100 in a shared manner Programs for controlling various components are stored in the ROM included in the control unit 111. Moreover, the RAM included in the control unit 111 is a volatile memory used for, for example, arithmetic processing.

The operation unit 112 is a user interface used to receive, from the user, an instruction issued to the imaging apparatus 100. The operation unit 112 includes, for example, the power switch 72 used to power on or off the imaging apparatus 100, the release switch 61 used to issue an instruction for image capturing, the playback button 79 used to issue an instruction to play back still image data or moving image data, and the mode changeover switch 60.

The operation unit 112 outputs a control signal to the control unit 111 according to an operation performed by the user. Moreover, a touch panel formed on the display unit 107 can also be included in the operation unit 112. Furthermore, the release switch 61 includes a switch SW1 and a switch SW2. When the release switch 61 comes into what is called a half-pressed state, the switch SW1 is turned on. With this user operation, the operation unit 112 receives an instruction for preparation to perform preparatory operations for image capturing, such as autofocus (AF) processing, automatic exposure (AE) processing, automatic white balance (AWB) processing, and electronic flash (EF) (preliminary flash emission) processing. Moreover, when the release switch 61 comes into what is called a fully-pressed state, the switch SW2 is turned on. With this user operation, the operation unit 112 receives an image capturing instruction for performing an image capturing operation. Moreover, the operation unit 112 includes an operation member (for example, a button) used to adjust the volume of audio data to be played back via a loudspeaker 114 described below.

An audio output unit 113 is able to output audio data to the loudspeaker 114 and the external output unit 115. Examples of audio data to be input to the audio output unit 113 include audio data read out from the recording medium 110 by the recording control unit 109, audio data output from a non-volatile memory 117, and audio data output from the coding processing unit 108. The loudspeaker 114 is an electro-acoustic transducer capable of playing back audio data.

The external output unit 115 is able to output, for example, still image data, moving image data, and audio data to an external apparatus. The external output unit 115 is configured with, for example, video terminals, microphone terminals, and headphone terminals.

The data bus 116 is a data bus used to transfer various pieces of data, such as audio data, moving image data, and still image data, and various control signals to the respective applicable blocks of the imaging apparatus 100.

The non-volatile memory 117 is a non-volatile memory, and stores therein, for example, a program described below which is to be executed by the control unit 111. Moreover, the non-volatile memory 117 also stores therein audio data. Examples of the audio data include audio data about electronic sound, such as in-focus sound which is output when the subject has become in focus, electronic shutter sound which is output when an instruction for image capturing has been issued, and operation sound which is output when the imaging apparatus 100 has been operated.

<Operation of Imaging Apparatus 100>

In the following description, an operation of the imaging apparatus 100 in the first exemplary embodiment is described.

When being powered on in response to the user operating the power switch 72, the imaging apparatus 100 in the first exemplary embodiment supplies electric power from a power source (not illustrated) to each component of the imaging apparatus 100. For example, the power source is a battery such as a lithium-ion battery or an alkaline manganese dry cell.

In response to being supplied with electric power, the control unit 111 determines, for example, in which of the image capturing mode and the playback mode to operate, based on a state of the mode changeover switch 60. In the moving image recording mode, the control unit 111 records, as a single piece of moving image data with sound, moving image data output from the imaging unit 101 and audio data output from the audio input unit 104. In the playback mode, the control unit 111 causes the recording control unit 109 to read out still image data or moving image data recorded on the recording medium 110 and display the read-out image data on the display unit 107.

First, the moving image recording mode is described. In the moving image recording mode, first, the control unit 111 transmits, to each component of the imaging apparatus 100, a control signal in such a way as to cause the imaging apparatus 100 to transition to an image capturing standby state. For example, the control unit 111 performs control in such a way as to cause the imaging unit 101 and the audio input unit 104 to perform the following operations.

The imaging unit 101 converts the optical image of a subject formed on an imaging plane via the optical lens 300 into an electrical signal with an image sensor and generates moving image data from the electrical signal. Then, the imaging unit 101 transmits the moving image data to the display control unit 106, so that the display control unit 106 displays the moving image data on the display unit 107. The user is able to make preparations for image capturing while viewing the moving image data displayed on the display unit 107.

The audio input unit 104 A/D-converts analog audio signals respectively input from a plurality of microphones, thus generating a plurality of digital audio signals. Then, the audio input unit 104 generates audio data having a plurality of channels from the plurality of digital audio signals. The audio input unit 104 transmits the generated audio data to the audio output unit 113, so that the audio output unit 113 plays back audio data via the loudspeaker 114. The user is able to adjust, via the operation unit 112, the sound volume of audio data to be recorded in moving image data with sound, while hearing audio data played back via the loudspeaker 114.

Next, in response to the LV button 76 being pressed by the user, the control unit 111 transmits an instruction signal for starting image capturing to each component of the imaging apparatus 100. For example, the control unit 111 performs control to cause the imaging unit 101, the audio input unit 104, the coding processing unit 108, and the recording control unit 109 to perform the following operations.

The imaging unit 101 converts the optical image of a subject formed on an imaging plane via the optical lens 300 into an electrical signal with an image sensor and generates moving image data from the electrical signal. Then, the imaging unit 101 transmits the moving image data to the display control unit 106, so that the display control unit 106 displays the moving image data on the display unit 107. Moreover, the imaging unit 101 transmits the generated moving image data to the volatile memory 105.

The audio input unit 104 A/D-converts analog audio signals respectively input from a plurality of microphones, thus generating a plurality of digital audio signals. Then, the audio input unit 104 generates audio data having a plurality of channels from the plurality of digital audio signals. Then, the audio input unit 104 transmits the generated audio data to the volatile memory 105.

The coding processing unit 108 reads out moving image data and audio data temporarily recorded on the volatile memory 105 and codes each of the read-out moving image data and audio data. The control unit 111 generates a data stream from the moving image data and audio data coded by the coding processing unit 108, and outputs the data stream to the recording control unit 109. The recording control unit 109 sequentially records the input data stream, as moving image data with sound, on the recording medium 110 in conformity with a file system, such as Universal Disk Format (UDF) or File Allocation Table (FAT).

The respective components of the imaging apparatus 100 continue performing the above-mentioned operations during moving image capturing.

Then, in response to the LV button 76 being pressed by the user, the control unit 111 transmits an instruction signal for ending image capturing to each component of the imaging apparatus 100. For example, the control unit 111 performs control in such a way as to cause the imaging unit 101, the audio input unit 104, the coding processing unit 108, and the recording control unit 109 to perform the following operations.

The imaging unit 101 stops generating moving image data. The audio input unit 104 stops generating audio data.

The coding processing unit 108 reads out and codes remaining moving image data and audio data currently recorded on the volatile memory 105. The control unit 111 generates a data stream from the moving image data and audio data coded by the coding processing unit 108, and outputs the data stream to the recording control unit 109.

The recording control unit 109 sequentially records the data stream, as a file of moving image data with sound, on the recording medium 110 in conformity with a file system, such as UDF or FAT. Then, in response to inputting of the data stream being stopped, the recording control unit 109 completes moving image data with sound. Upon completion of the moving image data with sound, a recording operation of the imaging apparatus 100 stops.

In response to the recording operation having stopped, the control unit 111 transmits a control signal to each component of the imaging apparatus 100 in such a way as to cause the imaging apparatus 100 to transition to the image capturing standby state. With this transmission, the control unit 111 performs control to cause the imaging apparatus 100 to return to the image capturing standby state.

Next, the playback mode is described. In the playback mode, the control unit 111 transmits a control signal to each component of the imaging apparatus 100 in such a way as to cause the imaging apparatus 100 to transition to the playback state. For example, the control unit 111 performs control in such a way as to cause the coding processing unit 108, the recording control unit 109, the display control unit 106, and the audio output unit 113 to perform the following operations.

The recording control unit 109 reads out moving image data with sound recorded on the recording medium 110, and transmits the read-out moving image data with sound to the coding processing unit 108.

The coding processing unit 108 decodes image data and audio data from the moving image data with sound. The coding processing unit 108 transmits the decoded moving image data to the display control unit 106 and transmits the decoded audio data to the audio output unit 113.

The display control unit 106 displays the decoded image data on the display unit 107. The audio output unit 113 plays back the decoded audio data via the loudspeaker 114.

In the above-mentioned way, the imaging apparatus 100 in the first exemplary embodiment is able to record and play back image data and audio data.

In the first exemplary embodiment, the audio input unit 104 performs audio processing such as adjustment processing of the level of an audio signal input from the microphones. In the first exemplary embodiment, the audio input unit 104 performs this audio processing in response to moving image recording being started. Furthermore, this audio processing can also be performed after the imaging apparatus 100 is powered on. Moreover, this audio processing can also be performed in response to the image capturing mode being selected. Moreover, this audio processing can also be performed in response to the moving image recording mode and a mode concerned with recording of sound, such as a voice memo function, being selected. Moreover, this audio processing can also be performed in response to recording of an audio signal being started.

<Configuration of Audio Input Unit 104>

Figure 3:
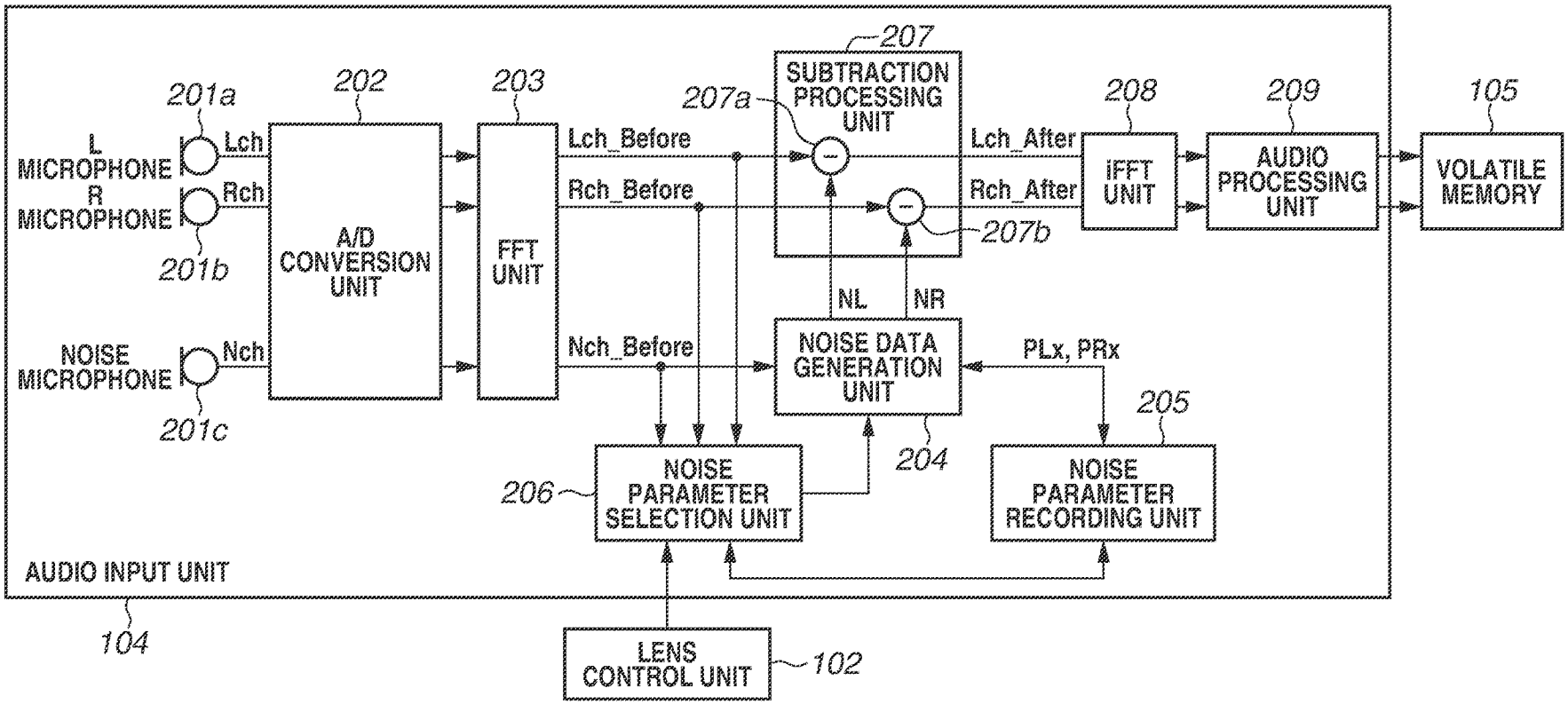
FIG. 3 is a block diagram illustrating a configuration of an audio input unit of the imaging apparatus in the first exemplary embodiment.

FIG. 3 is a block diagram illustrating an example of a detailed configuration of the audio input unit 104 in the first exemplary embodiment.

In the first exemplary embodiment, the audio input unit 104 includes three microphones, i.e., an L microphone 201*a*, an R microphone 201*b*, and a noise microphone 201*c*. Each of the L microphone 201*a* and the R microphone 201*b* is an example of a first microphone. In the first exemplary embodiment, the imaging apparatus 100 collects ambient sound with the L microphone 201*a* and the R microphone 201*b*, and records audio signals input from the L microphone 201*a* and the R microphone 201*b* in a stereophonic system. Examples of the ambient sound include sound occurring outside the housing of the imaging apparatus 100 and outside the lens unit 300, such as the voice of the user, the singing of an animal, the sound of rain, and music.

Moreover, the noise microphone 201*c* is an example of a second microphone. The noise microphone 201*c* is a microphone configured to collect sound noise (noise), such as drive sound from a predetermined sound noise source (noise source), occurring within the housing of the imaging apparatus 100 and within the housing of the optical lens 300. Examples of the noise source include motors such as an ultrasonic motor (USM) and a stepping motor (stepper motor) (STM). Examples of the sound noise (noise) include vibration sound occurring due to driving of a motor such as an USM or an STM. For example, the motor is driven for AF processing for focusing on a subject. The imaging apparatus 100 acquires, with the noise microphone 201*c*, sound noise (noise) such as drive sound occurring within the housing of the imaging apparatus 100 and within the housing of the optical lens 300, and generates a noise parameter described below using audio data about the acquired noise. Furthermore, in the first exemplary embodiment, each of the L microphone 201*a*, the R microphone 201*b*, and the noise microphone 201*c* is an omnidirectional microphone. An example of the arrangement of the L microphone 201*a*, the R microphone 201*b*, and the noise microphone 201*c* is described below with reference to FIG. 4.

Each of the L microphone 201*a*, the R microphone 201*b*, and the noise microphone 201*c* generates an analog audio signal from the collected sound, and inputs the analog audio signal to an A/D conversion unit 202. Here, an audio signal input from the L microphone 201*a* is referred to as "Lch", an audio signal input from the R microphone 201*b* is referred to as "Rch", and an audio signal input from the noise microphone 201*c* is referred to as "Nch".

The A/D conversion unit 202 converts analog audio signals input from the L microphone 201*a*, the R microphone 201*b*, and the noise microphone 201*c* into digital audio signals. The A/D conversion unit 202 outputs the digital audio signals obtained by conversion to a fast Fourier transform (FFT) unit 203. In the first exemplary embodiment, the A/D conversion unit 202 performs sampling processing with a sampling frequency of 48 kHz and a bit depth of 16 bits, thus converting an analog audio signal into a digital audio signal.

The FFT unit 203 performs fast Fourier transform processing on a time-domain digital audio signal input from the A/D conversion unit 202, thus converting the time-domain digital audio signal into a frequency-domain digital audio signal. In the first exemplary embodiment, the frequency-domain digital audio signal has a frequency spectrum of 1024 points in a frequency band of 0 Hz to 48 kHz. Moreover, the frequency-domain digital audio signal has a frequency spectrum of 513 points in a frequency band of 0 Hz to 24 kHz, which is a Nyquist frequency. In the first exemplary embodiment, the imaging apparatus 100 performs processing for noise reduction using a frequency spectrum of 513 points in a frequency band of 0 Hz to 24 kHz out of audio data output from the FFT unit 203.

Here, the frequency spectrum of Lch subjected to fast Fourier transform is expressed by array data of 513 points from Lch_Before[0] to Lch_Before[512]. These pieces of array data are collectively referred to as "Lch_Before". Moreover, the frequency spectrum of Rch subjected to fast Fourier transform is expressed by array data of 513 points from Rch_Before[0] to Rch_Before[512]. These pieces of array data are collectively referred to as "Rch_Before". Here, in the first exemplary embodiment, Lch_Before[0] is assumed to be a frequency spectrum of sound of 0 Hz, and Lch_Before[512] is assumed to be a frequency spectrum of sound of 24 kHz. Furthermore, each of Lch_Before and Rch_Before is an example of first frequency spectrum data.

Moreover, the frequency spectrum of Nch subjected to fast Fourier transform is expressed by array data of 513 points from Nch_Before[0] to Nch_Before[512]. These pieces of array data are collectively referred to as "Nch_Before". Furthermore, Nch_Before is an example of second frequency spectrum data.

A noise data generation unit 204 generates data for reducing noise included in Lch_Before and Rch_Before, based on Nch_Before. In the first exemplary embodiment, the noise data generation unit 204 generates, using noise parameters, array data of NL[0] to NL[512] for reducing noise included in Lch_Before[0] to Lch_Before[512]. Moreover, the noise data generation unit 204 generates, using noise parameters, array data of NR[0] to NR[512] for reducing noise included in Rch_Before[0] to Rch_Before [512]. Points in frequency in the array data of NL[0] to NL[512] are the same as points in frequency in the array data of Lch_Before[0] to Lch_Before[512]. Moreover, points in frequency in the array data of NR[0] to NR[512] are the same as points in frequency in the array data of Rch_Before [0] to Rch_Before[512].

Furthermore, the array data of NL[0] to NL[512] is collectively referred to as "NL". Moreover, the array data of NR[0] to NR[512] is collectively referred to as "NR". Each of NL and NR is an example of third frequency spectrum data.

Noise parameters which are used for the noise data generation unit 204 to generate NL and NR from Nch_Before are recorded in a noise parameter recording unit 205.

In the first exemplary embodiment, each of a plurality of types of lenses is able to be attached to the imaging apparatus 100. The plurality of types of lenses differs from each other in, for example, the focal length, the configuration of each lens, or the type of a motor. Therefore, the characteristic of noise caused to occur by each lens differs. The noise parameter recording unit 205 has recorded thereon a plurality of noise parameters respectively corresponding to the plurality of types of lenses. For example, the noise parameter recording unit 205 has recorded thereon a first noise parameter corresponding to a first type of lens and a second noise parameter corresponding to a second type of lens. Noise parameters used for generating NL from Nch_Before are collectively referred to as "PLx". Noise parameters used for generating NR from Nch_Before are collectively referred to as "PRx".

Each of PLx and PRx has the same number of arrays as each of NL and NR. For example, PL1 is array data of PL1[0] to PL1[512]. Moreover, the frequency points of PL1 are the same as the frequency points of Lch_Before. Moreover, for example, PR1 is array data of PR1[0] to PR1[512]. Moreover, the frequency points of PR1 are the same as the frequency points of Rch_Before. The noise parameters are described below with reference to FIG. 5.

A noise parameter selection unit 206 determines noise parameters which are to be used in the noise data generation unit 204, from among the noise parameters recorded on the noise parameter recording unit 205. The noise parameter selection unit 206 determines noise parameters which are to be used in the noise data generation unit 204, based on data including, for example, Lch_Before, Rch_Before, Nch_Before, and lens information received from the lens control unit 102. An operation of the noise parameter selection unit 206 is described below in detail with reference to FIG. 8.

Furthermore, in the first exemplary embodiment, all of the coefficients corresponding to the respective frequency spectra of 513 points as noise parameters are recorded on the noise parameter recording unit 205. However, instead of the coefficients corresponding to all of the frequency spectra of 513 points, at least the coefficients of frequency points required for reducing noise only need to be recorded. For example, the noise parameter recording unit 205 has recorded thereon, as noise parameters, coefficients respectively corresponding to the frequency spectra of 20 Hz to 20 kHz, which are typical audible frequencies, and does not need to have recorded thereon coefficients corresponding to the other frequencies. Moreover, for example, coefficients corresponding to frequency spectra the value of a coefficient for which is zero does not need to be recorded on the noise parameter recording unit 205.

A subtraction processing unit 207 subtracts NL and NR from Lch_Before and Rch_Before, respectively. For example, the subtraction processing unit 207 includes an L subtractor 207*a*, which subtracts NL from Lch_Before, and an R subtractor 207*b*, which subtracts NR from Rch_Before. The L subtractor 207*a* subtracts NL from Lch_Before and thus outputs array data of 513 points of Lch_After101 to Lch_After[512]. The R subtractor 207*b* subtracts NR from Rch_Before and thus outputs array data of 513 points of Rch_After101 to Rch_After[512]. In the first exemplary embodiment, the subtraction processing unit 207 performs subtraction processing using a spectral subtraction method.

An inverse fast Fourier transform (iFFT) unit 208 performs inverse fast Fourier transform (inverse Fourier transform) to convert the frequency-domain digital audio signal input from the subtraction processing unit 207 into a time-domain digital audio signal.

An audio processing unit 209 performs audio processing on the time-domain digital audio signal, such as equalization, automatic level control, and stereophonic effect emphasis processing. The audio processing unit 209 outputs audio data subjected to the audio processing to the volatile memory 105.

Furthermore, while, in the first exemplary embodiment, the imaging apparatus 100 includes two microphones as the first microphone, the imaging apparatus 100 can be configured to include one microphone or three or more microphones as the first microphone. For example, in a case where the audio input unit 104 includes one microphone as the first microphone, the imaging apparatus 100 records audio data acquired by one microphone in a monaural manner. Moreover, for example, in a case where the audio input unit 104 includes three or more microphones as the first microphone, the imaging apparatus 100 records audio data acquired by three or more microphones in a surround manner.

Furthermore, while, in the first exemplary embodiment, the L microphone 201*a*, the R microphone 201*b*, and the noise microphone 201*c* are configured to be omnidirectional microphones, these microphones can be directional microphones.

<Arrangement of Microphones of Audio Input Unit 104>

Figure 4:
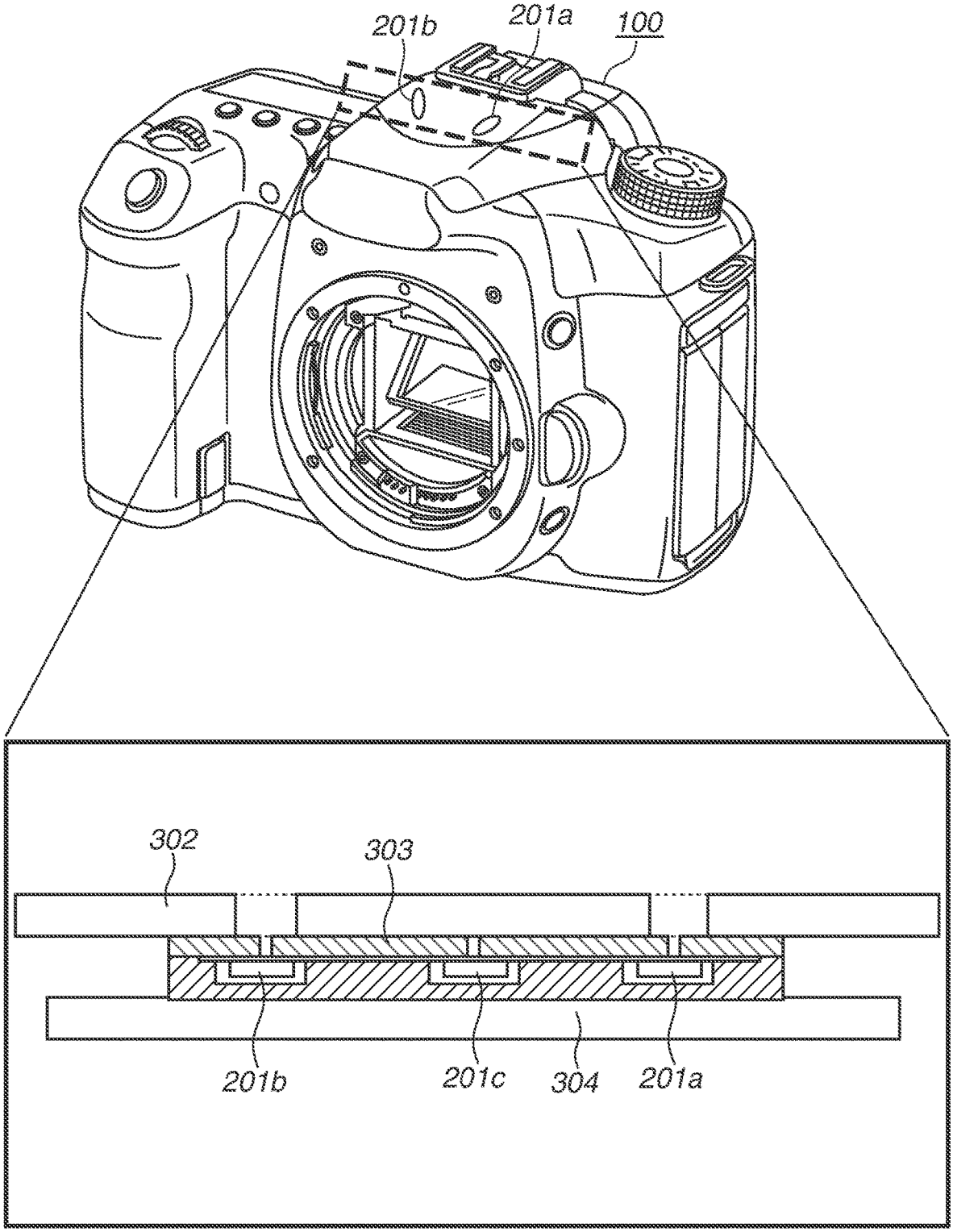
FIG. 4 is a diagram illustrating an arrangement of microphones in the audio input unit of the imaging apparatus in the first exemplary embodiment.

Here, an example of the arrangement of microphones of the audio input unit 104 in the first exemplary embodiment is described. FIG. 4 illustrates an example of the arrangement of the L microphone 201*a*, the R microphone 201*b*, and the noise microphone 201*c*.

FIG. 4 is an example of a sectional view of a part of the imaging apparatus 100 with the L microphone 201*a*, the R microphone 201*b*, and the noise microphone 201*c* attached thereto. Such a part of the imaging apparatus 100 is composed of an exterior portion 302, a microphone bush 303, and a fixing portion 304.

The exterior portion 302 has holes for inputting ambient sound to each microphone (hereinafter referred to as "opening portions"). In the first exemplary embodiment, the opening portions are formed above the L microphone 201*a* and the R microphone 201*b*. On the other hand, the noise microphone 201*c* is provided to acquire drive sound occurring within the housing of the imaging apparatus 100 and within the housing of the optical lens 300, and, therefore, does not need to acquire ambient sound. Accordingly, in the first exemplary embodiment, the exterior portion 302 has no opening portion formed above the noise microphone 201*c*.

Drive sound occurring within the housing of the imaging apparatus 100 and within the housing of the optical lens 300 is acquired by the L microphone 201*a* and the R microphone 201*b* via the opening portions. In a case where, for example, drive sound has occurred within the housings of the imaging apparatus 100 and the optical lens 300 in a state in which ambient sound is small, sound acquired by each microphone is mainly such drive sound. Therefore, the sound level obtained from the noise microphone 201*c* is larger than the sound level obtained from each of the L microphone 201*a* and the R microphone 201*b*. Thus, in this case, a relationship between levels of audio signals output from the respective microphones is as follows.

$$Lch \approx Rch < Nch$$

Moreover, as ambient sound becomes large, the sound level of ambient sound obtained from each of the L microphone 201*a* and the R microphone 201*b* becomes larger than the sound level of drive sound occurring in the imaging apparatus 100 or the optical lens 300 obtained from the noise microphone 201*c*. Therefore, in this case, a relationship between levels of audio signals output from the respective microphones is as follows.

$$Lch \approx Rch > Nch$$

Furthermore, in the first exemplary embodiment, the shape of each opening portion formed in the exterior portion 302 is an elliptical shape, but can be another shape such as a circular shape or a rectangular shape. Moreover, the shape of an opening portion located above the L microphone 201*a* and the shape of an opening portion located above the R microphone 201*b* can be different from each other.

Furthermore, in the first exemplary embodiment, the noise microphone 201*c* is located in proximity to the L microphone 201*a* and the R microphone 201*b*. Moreover, in the first exemplary embodiment, the noise microphone 201*c* is located between the L microphone 201*a* and the R microphone 201*b*. With this location, an audio signal generated by the noise microphone 201*c* from, for example, drive sound occurring within the housing of the imaging apparatus 100 and within the housing of the optical lens 300 becomes a signal analogous to an audio signal generated by each of the L microphone 201*a* and the R microphone 201*b* from, for example, such drive sound.

The microphone bush 303 is a member used to fix the L microphone 201*a*, the R microphone 201*b*, and the noise microphone 201*c* thereto. The fixing portion 304 is a member used to fix the microphone bush 303 to the exterior portion 302.

Furthermore, in the first exemplary embodiment, each of the exterior portion 302 and the fixing portion 304 is configured with a mold member made from, for example, a polycarbonate (PC) material. Moreover, each of the exterior portion 302 and the fixing portion 304 can be configured with a metallic member made from, for example, stainless steel. Moreover, in the first exemplary embodiment, the microphone bush 303 is configured with a rubber member made from, for example, ethylene-propylene-diene rubber.

<Noise Parameters>

FIG. 5 illustrates an example of noise parameters which are recorded on the noise parameter recording unit 205. The noise parameters illustrated in FIG. 5 are noise parameters concerned with noises occurring from a given lens. The noise parameters are parameters used to correct an audio signal generated by the noise microphone 201*c* acquiring drive sound occurring within the housing of the imaging apparatus 100 and within the housing of the optical lens 300. As illustrated in FIG. 5, in the first exemplary embodiment, PLx and PRx are recorded on the noise parameter recording unit 205. In the first exemplary embodiment, an example in which a source origin of drive sound lies within the housing of the optical lens 300 is described. Drive sound occurring within the housing of the optical lens 300 is transmitted to within the housing of the imaging apparatus 100 via the lens mount 301, and is then acquired by the L microphone 201*a*, the R microphone 201*b*, and the noise microphone 201*c*.

Depending on the types of drive sound, the frequency of drive sound differs. Therefore, in the first exemplary embodiment, the imaging apparatus 100 records thereon a plurality of noise parameters corresponding to the types of drive sound (noise). Then, the imaging apparatus 100 generates noise data using any of the plurality of noise parameters. In the first exemplary embodiment, the imaging apparatus 100 records thereon noise parameters for white noise, which is homeostatic noise. Moreover, the imaging apparatus 100 records thereon noise parameters for short-term noise, which occurs due to, for example, gears included in the optical lens 300 meshing with each other. Moreover, the imaging apparatus 100 records thereon noise parameters for long-term noise, which is, for example, sliding sound in the housing of the optical lens 300. In addition, the imaging apparatus 100 can be configured to record thereon noise parameters with respect to each type of the optical lens 300 and with respect to each temperature in the housing of the imaging apparatus 100 and each inclination of the imaging apparatus 100 detected by the information acquisition unit 103.

<Generation Method for Noise Data>

Generation processing for noise data which is performed by the noise data generation unit 204 is described with reference to FIGS. 6A, 6B, and 6C and FIGS. 7A, 7B, 7C, and 7D. While, here, generation processing for noise data with respect to data of Lch is described, the same applies to generation processing for noise data with respect to data of Rch.

Figure 6A:
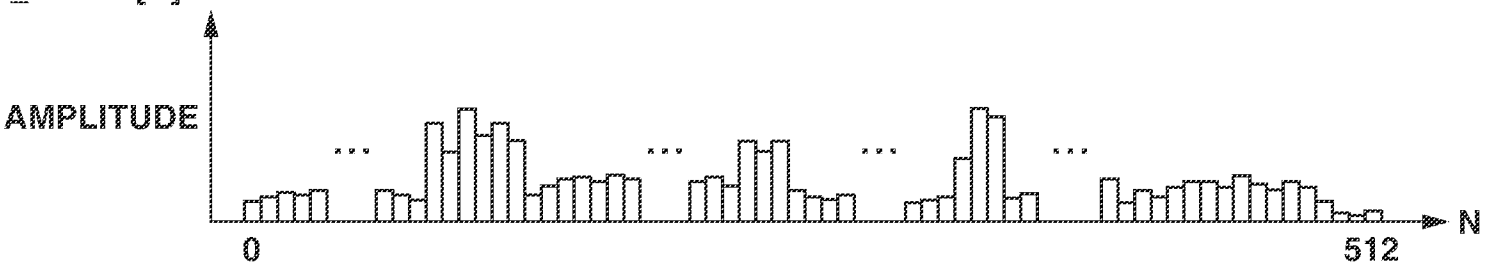
FIGS. 6A, 6B, and 6C are diagrams illustrating frequency spectra of sound obtained in a case where drive sound has occurred in a situation in which there is deemed to be no ambient sound and a frequency spectrum of noise parameters in the first exemplary embodiment.
Figure 6B:
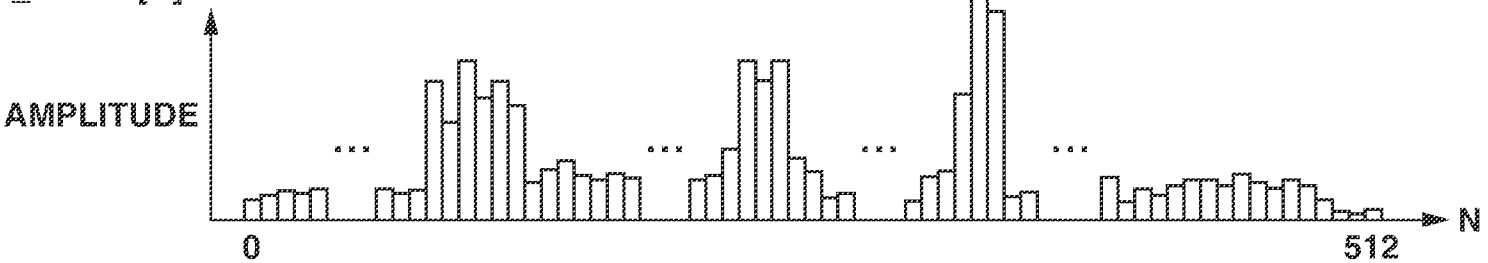

First, processing for generating noise parameters in a situation in which there is deemed to be no ambient sound is described. FIG. 6A illustrates an example of a frequency spectrum of Lch_Before obtained in a case where drive sound has occurred within the housing of the optical lens 300 in a situation in which there is deemed to be no ambient sound. FIG. 6B illustrates an example of a frequency spectrum of Nch_Before obtained in a case where drive sound has occurred within the housing of the optical lens 300 in a situation in which there is deemed to be no ambient sound. The horizontal axis is an axis indicating frequencies at the zero-th point to the 512-th point, and the vertical axis is an axis indicating the amplitude of the frequency spectrum.

Because of a situation in which there is deemed to be no ambient sound, in Lch_Before and Nch_Before, the amplitude of the frequency spectrum in the same frequency band becomes large. Moreover, since drive sound is occurring within the housing of the optical lens 300, Nch_Before tends to be larger in the amplitude of each frequency spectrum with respect to the same drive sound than Lch_Before.

Figure 6C:
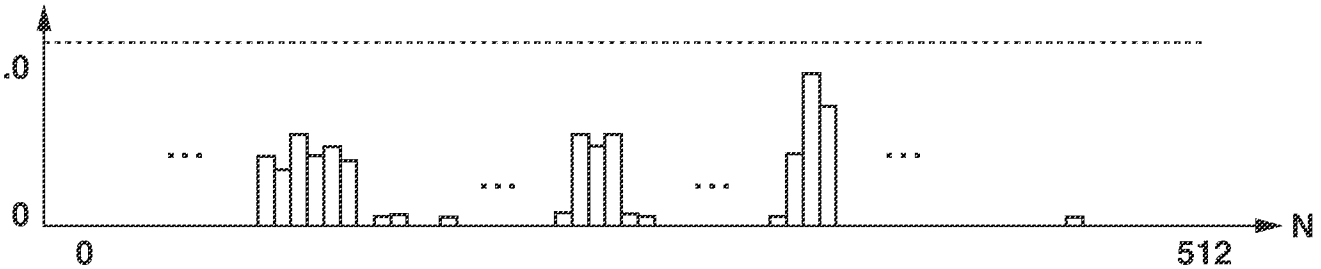

FIG. 6C illustrates an example of PLx in the first exemplary embodiment. In the first exemplary embodiment, PLx is a coefficient of each frequency spectrum calculated by dividing the amplitude of each frequency spectrum of Lch_Before by the amplitude of each frequency spectrum of Nch_Before. A result of this division is referred to as "Lch_Before/Nch_Before". Thus, PLx is the ratio in amplitude of Lch_Before to Nch_Before. The noise parameter recording unit 205 has recorded thereon the value of Lch_Before/Nch_Before as noise parameters PLx. Since, as mentioned above, Nch_Before tends to be larger in the amplitude of each frequency spectrum with respect to the same drive sound than Lch_Before, the value of each coefficient of the noise parameters PLx tends to become a value smaller than "1". However, in a case where the value of Nch_Before[n] is smaller than a predetermined threshold value, the noise parameter recording unit 205 records noise parameters PLx with PLx[n]=0 being set.

Figures 7A, 7B, 7C, 7D:
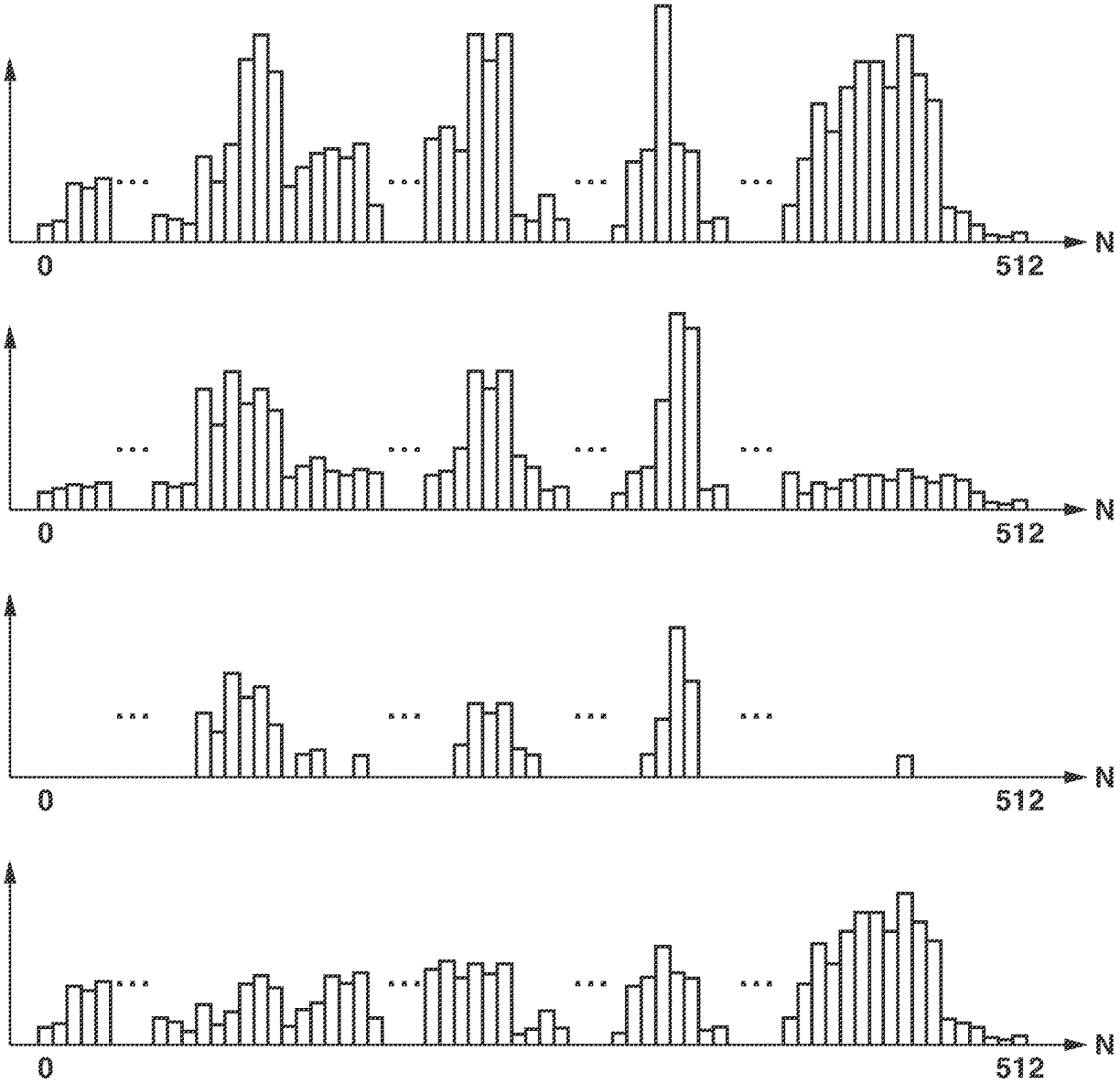
FIGS. 7A, 7B, 7C, and 7D are diagrams illustrating frequency spectra of sound obtained in a case where drive sound has occurred in a situation in which there is ambient sound in the first exemplary embodiment.

Next, processing for applying the generated noise parameters to Nch_Before is described. FIG. 7A illustrates an example of a frequency spectrum of Lch_Before obtained in a case where drive sound has occurred within the housing of the optical lens 300 in a situation in which there is ambient sound. FIG. 7B illustrates an example of a frequency spectrum of Nch_Before obtained in a case where drive sound has occurred within the housing of the optical lens 300 in a situation in which there is ambient sound. The horizontal axis is an axis indicating frequencies at the zero-th point to the 512-th point, and the vertical axis is an axis indicating the amplitude of the frequency spectrum.

FIG. 7C illustrates an example of NL obtained in a case where drive sound has occurred within the housing of the optical lens 300 in a situation in which there is ambient sound. The noise data generation unit 204 generates NL by multiplying each frequency spectrum of Nch_Before by each coefficient of PLx. NL is a frequency spectrum generated in this way.

FIG. 7D illustrates an example of Lch_After obtained in a case where drive sound has occurred within the housing of the optical lens 300 in a situation in which there is ambient sound. The subtraction processing unit 207 generates Lch_After by subtracting NL from Lch_Before. Lch_After is a frequency spectrum generated in this way.

This enables the imaging apparatus 100 to reduce noise caused by drive sound occurring within the housing of the optical lens 300 and record ambient sound with reduced noise.

<Description of Noise Parameter Selection Unit 206>

Figure 8:
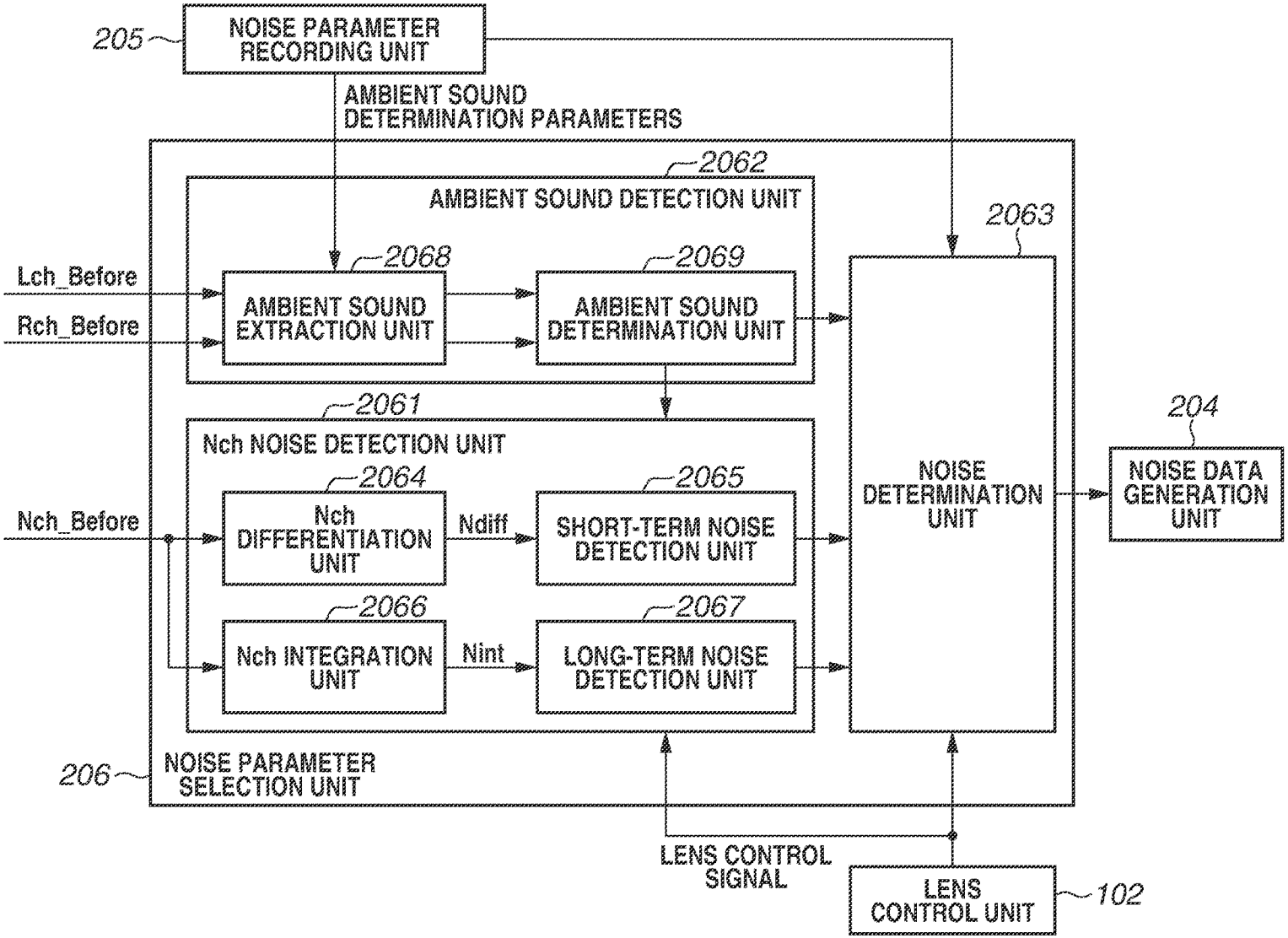
FIG. 8 is a block diagram illustrating a configuration of a noise parameter selection unit in the first exemplary embodiment.

FIG. 8 is a block diagram illustrating an example of a detailed configuration of the noise parameter selection unit 206.

The noise parameter selection unit 206 is configured to receive Lch_Before, Rch_Before, Nch_Before, lens information, and a lens control signal as inputs thereto.

An Nch noise detection unit 2061 detects, from Nch_Before, noise caused by drive sound occurring within the housing of the optical lens 300. Furthermore, in the first exemplary embodiment, the Nch noise detection unit 2061 detects noise using data at 513 points of Nch_Before.

An ambient sound detection unit 2062 detects the level of ambient sound from Lch_Before and Rch_Before.

A noise determination unit 2063 determines noise parameters which the noise data generation unit 204 uses, based on the lens information, the lens control signal, data input from the Nch noise detection unit 2061, and data input from the ambient sound detection unit 2062. The noise determination unit 2063 determines, as noise parameters which the noise data generation unit 204 uses, noise parameters corresponding to the type of lens indicated by the lens information output from the lens control unit 102 from among noise parameters recorded on the noise parameter recording unit 205. The noise determination unit 2063 outputs data indicating the type of the determined noise parameters to the noise data generation unit 204.

An Nch differentiation unit 2064 performs differential processing on Nch_Before. The Nch differentiation unit 2064 outputs data indicating a result of differential processing performed on Nch_Before to a short-term noise detection unit 2065. The short-term noise detection unit 2065 detects whether short-term noise is occurring, based on data input from the Nch differentiation unit 2064. The short-term noise detection unit 2065 outputs data indicating whether short-term noise is occurring to the noise determination unit 2063. Furthermore, the Nch differentiation unit 2064 and the short-term noise detection unit 2065 are included in the Nch noise detection unit 2061.

An Nch integration unit 2066 performs integration processing on Nch_Before. The Nch integration unit 2066 outputs data indicating a result of integration processing performed on Nch_Before to a long-term noise detection unit 2067. The long-term noise detection unit 2067 detects whether long-term noise is occurring, based on data input from the Nch integration unit 2066. The long-term noise detection unit 2067 outputs data indicating whether long-term noise is occurring to the noise determination unit 2063. Furthermore, the Nch integration unit 2066 and the long-term noise detection unit 2067 are included in the Nch noise detection unit 2061.

An ambient sound extraction unit 2068 extracts ambient sound. In the first exemplary embodiment, the ambient sound extraction unit 2068 extracts data with frequencies less affected by noise, based on the noise parameters. For example, the ambient sound extraction unit 2068 extracts data with frequencies the parameters about which are less than or equal to a predetermined value. Then, the ambient sound extraction unit 2068 outputs data indicating the magnitude of ambient sound based on the extracted data with such frequencies. Furthermore, the ambient sound extraction unit 2068 is included in the ambient sound detection unit 2062.

An ambient sound determination unit 2069 determines the magnitude of ambient sound. The ambient sound determination unit 2069 inputs data indicating the determined magnitude of ambient sound to the Nch noise detection unit 2061 and the noise determination unit 2063. The Nch noise detection unit 2061 changes a first threshold value and a second threshold value described below based on the data indicating the magnitude of ambient sound input from the ambient sound determination unit 2069. Furthermore, the ambient sound determination unit 2069 is included in the ambient sound detection unit 2062.

<Timing Charts of Noise Reduction Processing>

Noise reduction processing in the first exemplary embodiment is described with reference to FIGS. 9A, 9B, 9C, 9D, 9E, 9F, 9G, 9H, and 9I.

FIGS. 9A to 9I are examples of timing charts of audio processing in the noise data generation unit 204, the noise parameter selection unit 206, and the subtraction processing unit 207. While, in the first exemplary embodiment, for ease of explanation, audio processing in Lch is described, the same applies to audio processing in Rch. All of the horizontal axes of graphs illustrated in FIGS. 9A to 9I are time axes.

Figures 9A, 9B, 9C, 9D, 9E, 9F, 9G, 9H, 9I:
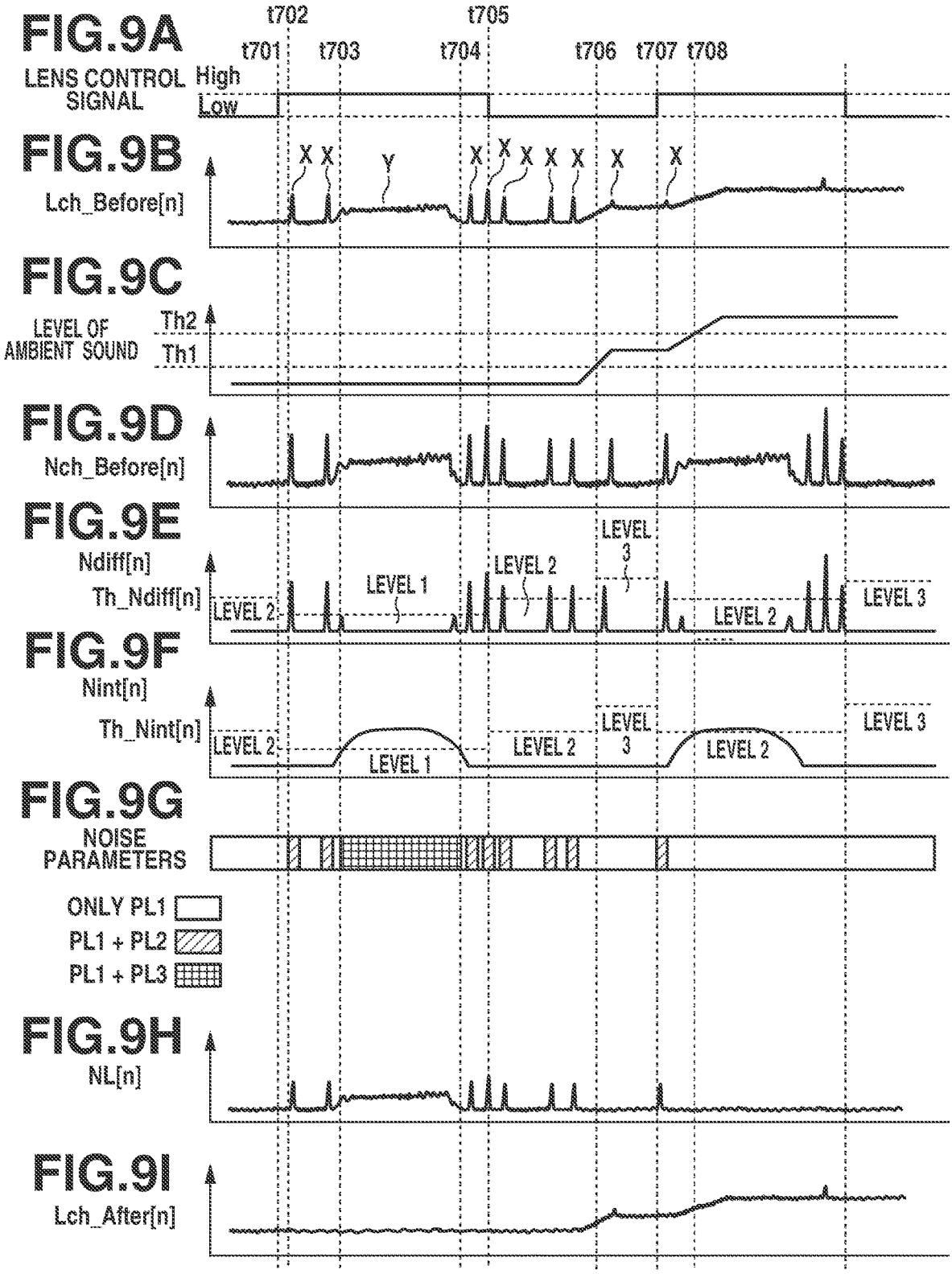
FIGS. 9A, 9B, 9C, 9D, 9E, 9F, 9G, 9H, and 9I are timing charts concerned with sound noise reduction processing in the first exemplary embodiment.

FIG. 9A illustrates an example of a lens control signal. The lens control signal is a signal which the lens control unit 102 outputs to issue an instruction to drive the optical lens 300. In the first exemplary embodiment, the level of the lens control signal is expressed by two values, i.e., High and Low. In a case where the level of the lens control signal is High, the lens control unit 102 is in a state of issuing an instruction to drive the optical lens 300. In a case where the level of the lens control signal is Low, the lens control unit 102 is in a state of not issuing an instruction to drive the optical lens 300.

FIG. 9B is a graph illustrating an example of the value of Lch_Before[n]. The vertical axis is an axis indicating the value of Lch_Before[n]. In the first exemplary embodiment, Lch_Before[n] is a signal at the n-th frequency point at which a signal representing drive sound of the optical lens 300 characteristically appears, out of Lch_Before output from the FFT unit 203. Furthermore, while, in the first exemplary embodiment, a signal at the n-th frequency point is described, similar audio processing is performed on the other frequencies. Moreover, signals indicated by a signal X and a signal Y are signals in which noise is included. In the first exemplary embodiment, the signal X indicates a signal in which short-term noise is included, and the signal Y indicates a signal in which long-term noise is included.

FIG. 9C is a graph illustrating an example of the magnitude of ambient sound extracted by the ambient sound extraction unit 2068. The vertical axis indicates the level of an audio signal generated from the acquired ambient sound. A threshold value Th1 and a threshold value Th2 are two threshold values which are used in the ambient sound determination unit 2069.

FIG. 9D is a graph illustrating an example of the value of Nch_Before[n]. In the first exemplary embodiment, Nch_Before[n] is a signal at the n-th frequency point at which a signal representing drive sound of the optical lens 300 characteristically appears, out of Nch_Before output from the FFT unit 203. The vertical axis is an axis indicating the value of Nch_Before[n]. In Nch_Before[n], noise signals indicated by the signal X and signal Y illustrated in FIG. 9B more characteristically appear than in Lch_Before[n].

FIG. 9E is a graph illustrating an example of the value of Ndiff[n]. Ndiff[n] indicates the value of a signal at the n-th frequency point out of Ndiff output from the Nch differentiation unit 2064. The vertical axis is an axis indicating the value of Ndiff[n]. In a case where an amount of change in value of Nch_Before[n] per a predetermined time is large, the value of Ndiff[n] becomes large. The short-term noise detection unit 2065 has a threshold value Th_Ndiff[n], which is a first threshold value, to detect short-term noise. The threshold value Th_Ndiff[n] changes between level 1 to level 3 based on the data indicating the magnitude of ambient sound input from the ambient sound determination unit 2069 and the lens control signal. The initial value of the threshold value Th_Ndiff[n] is assumed to be level 2. Moreover, the level of the threshold value Th_Ndiff[n] is represented by a horizontal dashed line in FIG. 9E.

FIG. 9F is a graph illustrating an example of the value of Nint[n]. Nint[n] indicates the value of a signal at the n-th frequency point out of Nint output from the Nch integration unit 2066. The vertical axis is an axis indicating the value of Nint[n]. In a case where Nch_Before[n] is continually large, the value of Nint[n] becomes large. The long-term noise detection unit 2067 has a threshold value Th_Nint[n], which is a second threshold value, to detect long-term noise. The threshold value Th_Nint[n] changes between level 1 to level 3 based on the data indicating the magnitude of ambient sound input from the ambient sound determination unit 2069 and the lens control signal. The initial value of the threshold value Th_Nint[n] is assumed to be level 2. Moreover, the level of the threshold value Th_Nint[n] is represented by a horizontal dashed line in FIG. 9F.

FIG. 9G illustrates an example of noise parameters selected by the noise parameter selection unit 206. In the first exemplary embodiment, a plain white portion indicates that only noise parameters of PL1 are selected. A hatched portion indicates that noise parameters of PL1 and PL2 are selected. A checkered portion indicates that noise parameters of PL1 and PL3 are selected.

FIG. 9H is a graph illustrating an example of the value of NL[n]. In the first exemplary embodiment, NL[n] indicates the value of a signal at the n-th frequency point out of NL generated by the noise data generation unit 204. The vertical axis is an axis indicating the value of NL[n].

FIG. 9I is a graph illustrating an example of the value of Lch_After[n]. In the first exemplary embodiment, Lch_After[n] indicates the value of a signal at the n-th frequency point out of Lch_After output from the subtraction processing unit 207. The vertical axis is an axis indicating the value of Lch_After[n].

Next, timing concerning respective operations is described with use of time t701 to time t709.

At time t701, the lens control unit 102 outputs a signal at High as the lens control signal to the optical lens 300 and the noise parameter selection unit 206 (FIG. 9A). At time t701, since it is highly likely that drive sound occurs within the housing of the optical lens 300, the short-term noise detection unit 2065 lowers the threshold value Th_Ndiff[n] to level 1 (FIG. 9E). Moreover, at time t701, since it is highly likely that drive sound occurs within the housing of the optical lens 300, the long-term noise detection unit 2067 lowers the threshold value Th_Nint[n] to level 1 (FIG. 9F).

At time t702, when the optical lens 300 is driven, short-term drive sound such as gear meshing sound occurs. When the noise microphone 201*c* collects such short-term drive sound, the value of Ndiff[n] exceeds the threshold value Th_Ndiff[n] (FIG. 9E). In response to this, the noise parameter selection unit 206 selects the noise parameters PL1 and PL2 (FIG. 9G). The noise data generation unit 204 generates NL[n] based on Nch_Before[n] and the noise parameters PL1 and PL2 (FIG. 9H). The subtraction processing unit 207 subtracts NL[n] from Lch_Before[n], and thus outputs Lch_After[n] (FIG. 9I). In this case, Lch_After[n] becomes an audio signal with homeostatic noise and short-term noise reduced.

At time t703, when the optical lens 300 starts being continuously driven, long-term drive sound such as sliding sound occurs within the housing of the optical lens 300. When the noise microphone 201*c* collects such long-term drive sound, the value of Nint[n] exceeds the threshold value Th_Nint[n] (FIG. 9F). In response to this, the noise parameter selection unit 206 selects noise parameters PL1 and PL3 (FIG. 9G). The noise data generation unit 204 generates NL[n] based on Nch_Before[n] and the noise parameters PL1 and PL3 (FIG. 9H). The subtraction processing unit 207 subtracts NL[n] from Lch_Before[n] and thus outputs Lch_After[n] (FIG. 9I). In this case, Lch_After[n] becomes an audio signal with homeostatic noise and long-term noise reduced.

At time t704, the optical lens 300 stops being continuously driven. Since the noise microphone 201*c* becomes not collecting such long-term drive sound, the value of Nint[n] becomes less than or equal to the threshold value Th_Nint[n] (FIG. 9F). In response to this, the noise parameter selection unit 206 selects noise parameters PL1 (FIG. 9G). The noise data generation unit 204 generates NL[n] based on Nch_Before[n] and the noise parameters PL1 (FIG. 9H). The subtraction processing unit 207 subtracts NL[n] from Lch_Before[n] and thus outputs Lch_After[n] (FIG. 9I). In this case, Lch_After[n] becomes an audio signal with homeostatic noise reduced.

At time t705, the lens control unit 102 outputs a signal of Low as the lens control signal to the optical lens 300 and the noise parameter selection unit 206 (FIG. 9A). In this case, since it becomes unlikely that drive sound occurs within the housing of the optical lens 300, the short-term noise detection unit 2065 raises the threshold value Th_Ndiff[n] to level 2 (FIG. 9E). Moreover, in this case, since it becomes unlikely that drive sound occurs within the housing of the optical lens 300, the long-term noise detection unit 2067 raises the threshold value Th_Nint[n] to level 2 (FIG. 9F).

At time t706, the magnitude of ambient sound extracted by the ambient sound extraction unit 2068 exceeds the threshold value Th1. In a case where the ambient sound is large, since the user becomes unlikely to feel noise included in the audio signal, the short-term noise detection unit 2065 raises the threshold value Th_Ndiff[n] to level 3 (FIG. 9E). Moreover, in a case where the ambient sound is large, since the user becomes unlikely to feel noise included in the audio signal, the long-term noise detection unit 2067 raises the threshold value Th_Nint[n] to level 3 (FIG. 9F).

At time t707, the lens control unit 102 outputs a signal of High as the lens control signal to the optical lens 300 and the noise parameter selection unit 206 (FIG. 9A). In this case, since it is highly likely that drive sound occurs within the housing of the optical lens 300, the short-term noise detection unit 2065 lowers the threshold value Th_Ndiff[n] to level 2 (FIG. 9E). Moreover, in this case, since it is highly likely that drive sound occurs within the housing of the optical lens 300, the long-term noise detection unit 2067 lowers the threshold value Th_Nint[n] to level 2 (FIG. 9F).

At time t708, the magnitude of ambient sound extracted by the ambient sound extraction unit 2068 exceeds the threshold value Th2. Here, irrespective of data input from the Nch noise detection unit 2061, the noise parameter selection unit 206 selects only the noise parameters PL1. In this way, in a case where the ambient sound is very large, since the user is unlikely to feel included in the audio signal, the imaging apparatus 100 reduces only homeostatic noise, thus recording more natural ambient sound than in the case of further performing processing for reducing short-term noise and long-term noise.

In the above-described way, the imaging apparatus 100 is able to record ambient sound with noise reduced, by performing noise reduction processing using the noise microphone 201*c*, which is the second microphone.

Moreover, the imaging apparatus 100 uses the output signal from the noise microphone 201*c* to detect that noise is occurring, and sets noise parameters in conformity with timing at which the occurrence of noise has been detected. Therefore, the imaging apparatus 100 is able to appropriately set noise parameters in synchronization with the occurrence of noise and thus appropriately reduce noise.

Moreover, in a case where the magnitude of ambient sound is less than or equal to the threshold value Th2, the imaging apparatus 100 performs nose reduction processing according to noise detected by the Nch noise detection unit 2061, and, in a case where the magnitude of ambient sound is greater than the threshold value Th2, the imaging apparatus 100 reduces only homeostatic noise. This enables the imaging apparatus 100 to record ambient sound with nose reduced in such a way as to make a feeling of strangeness for the user smaller according to the magnitude of ambient sound.

Furthermore, in the first exemplary embodiment, the imaging apparatus 100 reduces drive sound occurring within the housing of the optical lens 300, but can be configured to reduce drive sound occurring within the imaging apparatus 100. Examples of the drive sound occurring within the imaging apparatus 100 include squeak of a substrate and radio wave noise. Furthermore, squeak of a substrate is sound occurring due to a creak of the substrate occurring when, for example, a voltage is applied to a capacitor on the substrate.

Furthermore, the threshold value Th1 and threshold value Th2 for the ambient sound determination unit 2069, the threshold value Th_Ndiff[n] for the short-term noise detection unit 2065, and the threshold value Th_Nint[n] for the long-term noise detection unit 2067 are determined based on drive sound and ambient sound occurring. Therefore, the imaging apparatus 100 can be configured to change each of these threshold values depending on, for example, the type of the optical lens 300 and the inclination of the imaging apparatus 100.

<Noise Parameters for Each Lens>

First, a case where the optical lens 300 has been replaced and the same noise parameters have been applied to the respective lenses is described with reference to FIGS. 7A to 7D and FIGS. 11A, 11B, 11C, and 11D. With regard to FIGS. 7A to 7D and FIGS. 11A to 11D, respective different lenses are assumed to be attached to the imaging apparatus 100. Furthermore, FIGS. 7A to 7D and FIGS. 11A to 11D illustrate a situation in which the same ambient sound is occurring.

Figures 11A, 11B, 11C, 11D:
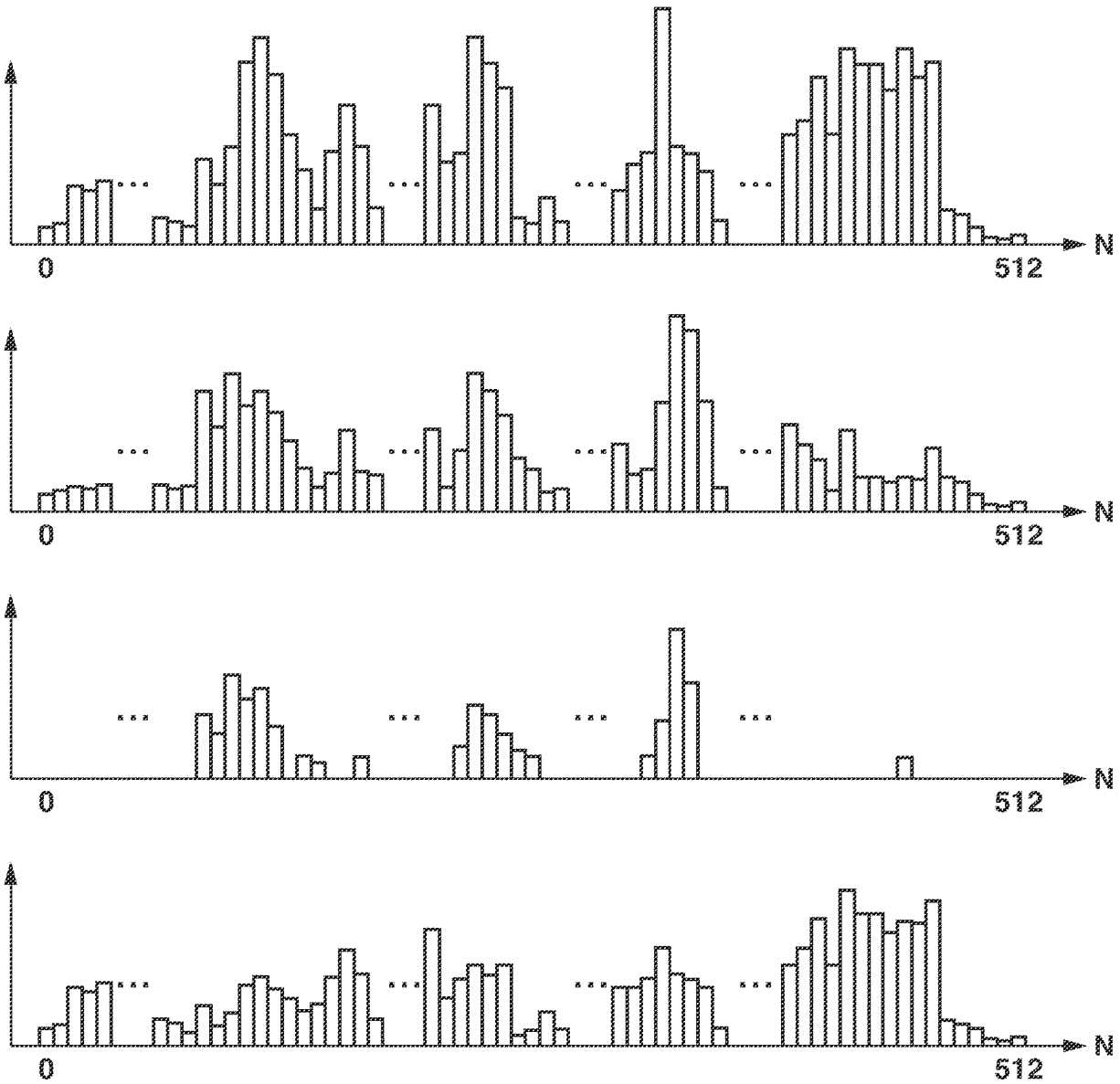
FIGS. 11A, 11B, 11C, and 11D are diagrams illustrating frequency spectra of sound obtained in a case where drive sound has occurred in a situation in which there is ambient sound in the first exemplary embodiment.

FIG. 7A and FIG. 11A illustrate amplitudes of respective frequency spectra of Lch_Before. FIG. 7B and FIG. 11B illustrate amplitudes of respective frequency spectra of Nch_Before. Here, when respective frequency spectra are compared with each other, it can be read that at least a part thereof differs from each other. This is because noises respectively collected by the L microphone 201*a*, the R microphone 201*b*, and the noise microphone 201*c* differ depending on the shape and structure of each lens and the number and positions of noise sources, such as drivers, included in each lens.

FIG. 7C and FIG. 11C illustrate amplitudes of respective frequency spectra of NL. Here, irrespective of the lens attached to the imaging apparatus 100, NL is generated with use of the same noise parameters.

FIG. 7D and FIG. 11D illustrate amplitudes of respective frequency spectra of Lch_After. Since Lch_After is an audio signal to be recorded as ambient sound, ideally, the frequency spectra illustrated in FIG. 7D and FIG. 11D become the same. However, when respective frequency spectra illustrated in FIG. 7D and FIG. 11D are compared with each other, it can be read that at least a part thereof differs from each other. This is because the frequency spectrum of NL which is subtracted from Lch_Before differs from the frequency spectrum of noise occurring in each lens. The reason why the frequency spectrum of NL differs from the frequency spectrum of noise is that the noise parameters are not parameters generated in conformance with noise occurring in each lens but general-purpose parameters generated with respect to a given type of noise. Thus, in a case where the same noise parameters are applied to respective noises occurring from various types of lenses, audio data which is recorded as ambient sound on the recording medium 110 may become audio data which differs depending on each lens attached to the imaging apparatus 100.

Therefore, in the first exemplary embodiment, the imaging apparatus 100 makes noise parameters different for each lens, thus being able to efficiently reduce noise and more accurately record ambient sound. FIG. 10 illustrates an example of noise parameters for respective lenses each attachable to the imaging apparatus 100 as the optical lens 300. In FIG. 10, noise parameters of PL2 and PR2 are shown with respect to the default value and each lens. In the first exemplary embodiment, the noise parameter recording unit 205 previously records thereon lens parameters for respective lenses. Furthermore, the noise parameter recording unit 205 also records thereon noise parameters of PLx and PRx, which are other lens parameters, for respective lenses.

Furthermore, in the first exemplary embodiment, the noise parameter recording unit 205 previously records thereon, as the default value, noise parameters for lenses other than the lenses the noise parameters for which are previously recorded. This is because the imaging apparatus 100 applies general-purpose noise parameters to noise occurring from a lens the noise parameters for which are not previously recorded, thus being able to reduce noise propagating from the lens to some extent.

Figure 12:
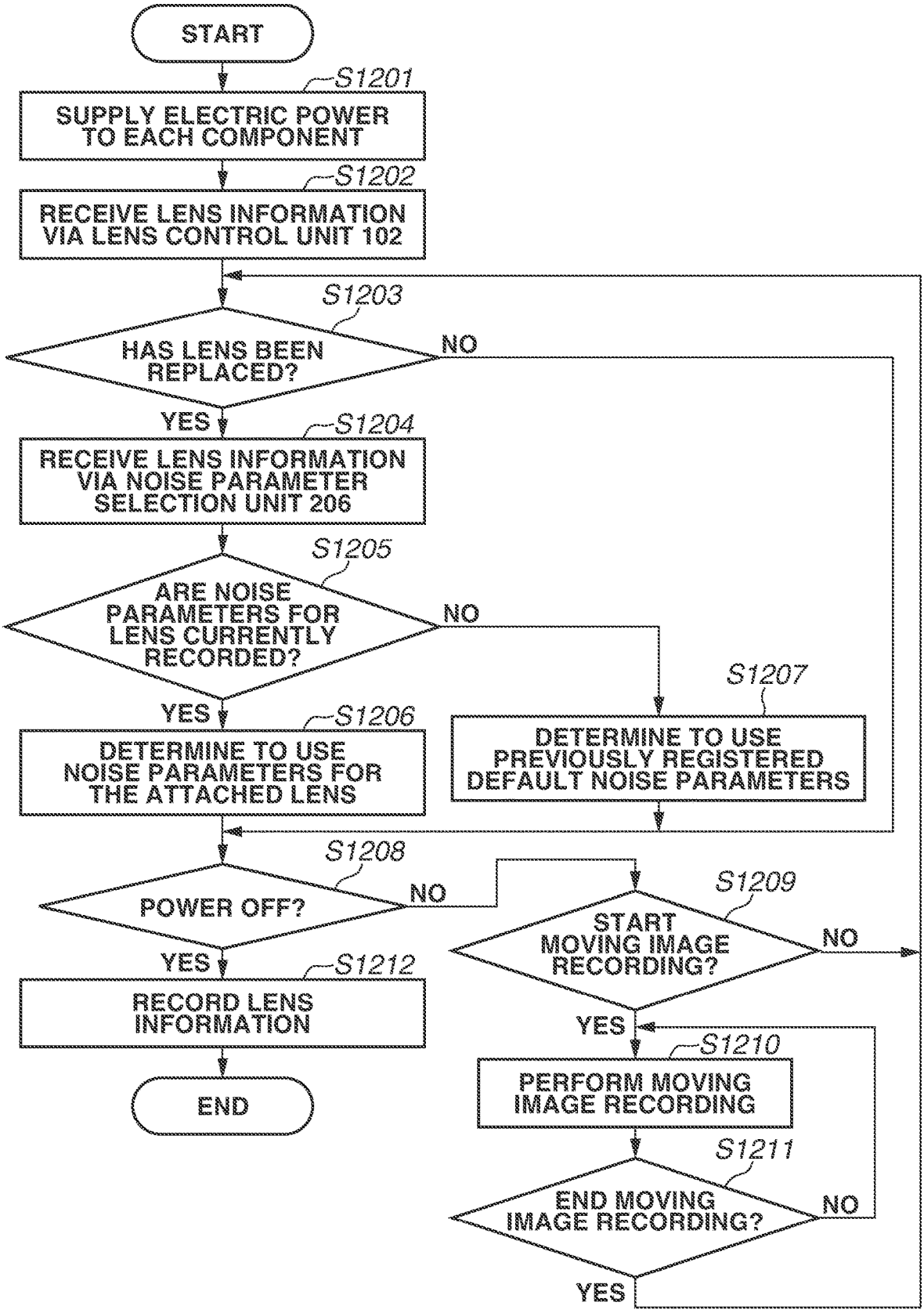
FIG. 12 is a flowchart illustrating processing which is performed by the imaging apparatus in the first exemplary embodiment.

In the following description, processing which is performed by the imaging apparatus 100 in a case where the optical lens 300 is replaced is described with reference to the flowchart of FIG. 12. The processing which is performed by the imaging apparatus 100 is started with a trigger of, for example, the power switch 72 being operated by the user to power on the imaging apparatus 100.

In step S1201, the control unit 111 performs control to supply electric power from a power source (not illustrated) to each component of the imaging apparatus 100.

In step S1202, the lens control unit 102 receives lens information from the optical lens 300. Examples of the lens information include the type of a lens, the model number of a lens, and the type of a noise source. The control unit 111 records the received lens information on the non-volatile memory 117.

In step S1203, the lens control unit 102 determines whether the lens has been replaced. For example, the lens control unit 102 compares the lens information recorded on the non-volatile memory 117 before processing in step S1202 with the lens information received in step S1202. When determining that two pieces of lens information are identical with each other, the lens control unit 102 determines that the lens has not been replaced. When determining that two pieces of lens information are not identical with each other, the lens control unit 102 determines that the lens has been replaced. Moreover, for example, in a case where, before processing in step S1202, lens information is not recorded on the non-volatile memory 117, the lens control unit 102 determines that the lens has been replaced. If it is determined that the lens has been replaced (YES in step S1203), the lens control unit 102 advances the processing to step S1204. If it is determined that the lens has not been replaced (NO in step S1203), the lens control unit 102 advances the processing to step S1208.

In step S1204, the noise parameter selection unit 206 receives lens information from the lens control unit 102.

In step S1205, the noise parameter selection unit 206 determines whether noise parameters for the optical lens 300 attached to the imaging apparatus 100 are currently recorded on the noise parameter recording unit 205. For example, the noise parameter selection unit 206 determines, based on the model number of a lens included in the lens information received in step S1204, whether noise parameters for the lens are currently recorded on the noise parameter recording unit 205. If it is determined that the noise parameters for the optical lens 300 are currently recorded on the noise parameter recording unit 205 (YES in step S1205), the noise parameter selection unit 206 advances the processing to step S1206. If it is determined that the noise parameters for the optical lens 300 are not currently recorded on the noise parameter recording unit 205 (NO in step S1205), the noise parameter selection unit 206 advances the processing to step S1207.

In step S1206, the noise parameter selection unit 206 determines to use the noise parameters for the optical lens 300, and instructs the noise data generation unit 204 to use those noise parameters. For example, the noise parameter selection unit 206 transmits data indicating the model number of the optical lens 300 to the noise data generation unit 204. Furthermore, in this case, when reading noise parameters from the noise parameter recording unit 205, the noise data generation unit 204 reads the noise parameters for the optical lens 300 specified by the noise parameter selection unit 206.

In step S1207, the noise parameter selection unit 206 determines to use default noise parameters, and instructs the noise data generation unit 204 to use those noise parameters. For example, the noise parameter selection unit 206 transmits data indicating the default value to the noise data generation unit 204. Furthermore, in this case, when reading noise parameters from the noise parameter recording unit 205, the noise data generation unit 204 reads the default noise parameters specified by the noise parameter selection unit 206.

In step S1208, the control unit 111 determines whether to power off the imaging apparatus 100. For example, in a case where the power switch 72 has been operated to be turned off, the control unit 111 determines to power off the imaging apparatus 100. If it is determined to power off the imaging apparatus 100 (YES in step S1208), the control unit 111 advances the processing to step S1212. If it is determined not to power off the imaging apparatus 100 (NO in step S1208), the control unit 111 advances the processing to step S1209.

In step S1209, the control unit 111 determines whether to start moving image recording. For example, in response to the release switch 61 being pressed, the control unit 111 determines to start moving image recording. On the other hand, in a case where the release switch 61 is not pressed, the control unit 111 determines not to start moving image recording. If it is determined to start moving image recording (YES in step S1209), the control unit 111 advances the processing to step S1210. If it is determined not to start moving image recording (NO in step S1209), the control unit 111 returns the processing to step S1203.

In step S1210, the control unit 111 performs moving image recording. For example, as mentioned above, the control unit 111 records moving image data with sound on the recording medium 110. In audio processing in the process of this moving image recording, noise parameters determined in processing in step S1206 or processing in step S1207 are used.

In step S1211, the control unit 111 determines whether to end moving image recording. For example, in response to the release switch 61 being pressed, the control unit 111 determines to end moving image recording. On the other hand, in a case where the release switch 61 is not pressed, the control unit 111 determines not to end moving image recording. If it is determined to end moving image recording (YES in step S1211), the control unit 111 returns the processing to step S1203. If it is determined not to end moving image recording (NO in step S1211), the control unit 111 returns the processing to step S1210.

In step S1212, the control unit 111 records lens information on the non-volatile memory 117. The lens information recorded in step S1212 is used for a case where processing in step S1203 is performed next.

Thus far is the description of processing which is performed by the imaging apparatus 100 in a case where the optical lens 300 is replaced.

In the above-described way, changing noise parameters depending on the optical lens 300 attached to the imaging apparatus 100 enables performing efficient noise reduction processing.

Furthermore, in the first exemplary embodiment, noise parameters are recorded for each lens but can be recorded for each type of noise source. For example, the imaging apparatus 100 prepares noise parameters for respective lenses, i.e., a lens in which a USM is included and a lens in which an STM is included. In this case, the noise parameter selection unit 206 instructs the noise data generation unit 204 to use noise parameters for the USM or noise parameters for the STM based on the type of noise source included in the lens information received from the lens control unit 102.

In the first exemplary embodiment, the imaging apparatus 100 uses noise parameters corresponding to the type of a lens attached to the imaging apparatus 100. In a second exemplary embodiment, processing for, in addition to using noise parameters corresponding to the type of a lens attached to the imaging apparatus 100, using noise parameters corresponding to the orientation of the imaging apparatus 100 and the state of the lens is described.

The second exemplary embodiment is described with use of an imaging apparatus 100 similar to that in the first exemplary embodiment. Furthermore, the configuration of the imaging apparatus 100 is similar to that in the first exemplary embodiment, and is, therefore, omitted from description.

Figure 13:
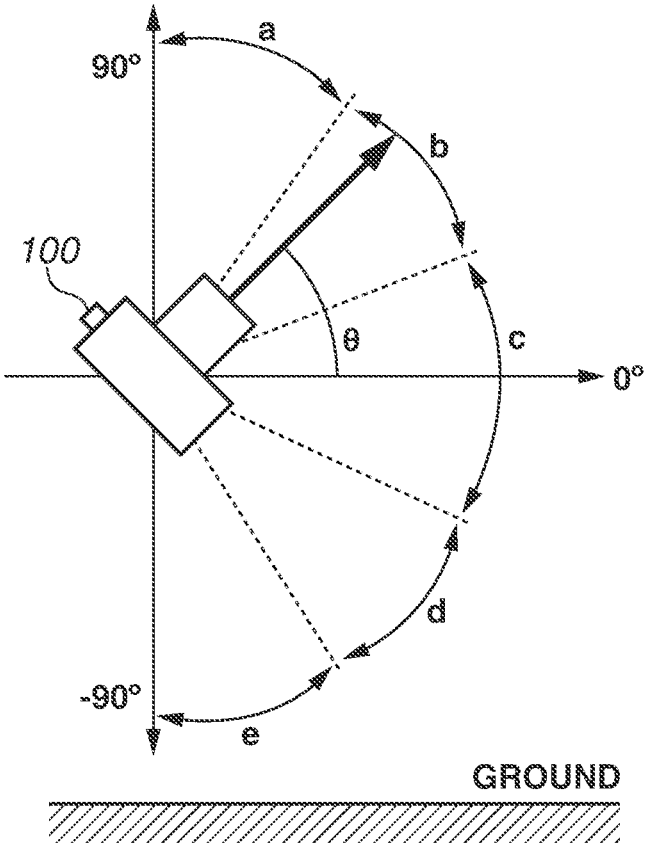
FIG. 13 is a diagram illustrating orientation information about the imaging apparatus in a second exemplary embodiment.

FIG. 13 is a diagram illustrating orientation information about the imaging apparatus 100 in the second exemplary embodiment. In the second exemplary embodiment, a state in which the image capturing direction of the imaging apparatus 100 is parallel to the ground is assumed to be angle 0°. Moreover, a state in which the image capturing direction of the imaging apparatus 100 is upward perpendicular to the ground is assumed to be angle 90°. Moreover, a state in which the image capturing direction of the imaging apparatus 100 is downward perpendicular to the ground is assumed to be angle −90°. Here, an angle θ indicates the angle of the image capturing direction of the imaging apparatus 100. In the second exemplary embodiment, the imaging apparatus 100 acquires, via the information acquisition unit 103, orientation information about the imaging apparatus 100. For example, the information acquisition unit 103 detects the inclination of the imaging apparatus 100 with an acceleration sensor or a gyroscope sensor.

In the second exemplary embodiment, the range of the image capturing direction of the imaging apparatus 100 is divided into five ranges. The range a is assumed to be 60° to 90°, the range b is assumed to be 30° to 60°, the range c is assumed to be −30° to 30°, the range d is assumed to be −0° to −30°, and the range e is assumed to be −90° to −60°. For example, in a case where the angle θ, which is the image capturing direction of the imaging apparatus 100, is 50°, the image capturing direction is within the range b. Furthermore, while, in the second exemplary embodiment, the range of the image capturing direction of the imaging apparatus 100 is divided into five ranges, the range of the image capturing direction of the imaging apparatus 100 only needs to be divided into a plurality of ranges.

The gravitational force acting on a motor included in the lens, which is a noise source in the second exemplary embodiment, changes according to the orientation of the imaging apparatus 100. When the gravitational force changes, a holding force of a holding mechanism for holding the lens changes, and the motion of a motor for driving the holding mechanism also changes. Therefore, drive sound which occurs when the motor is driven also changes according to the gravitational force, and the frequency characteristics of noise collected by each microphone also change according to the gravitational force.

Figures 14A, 14B:
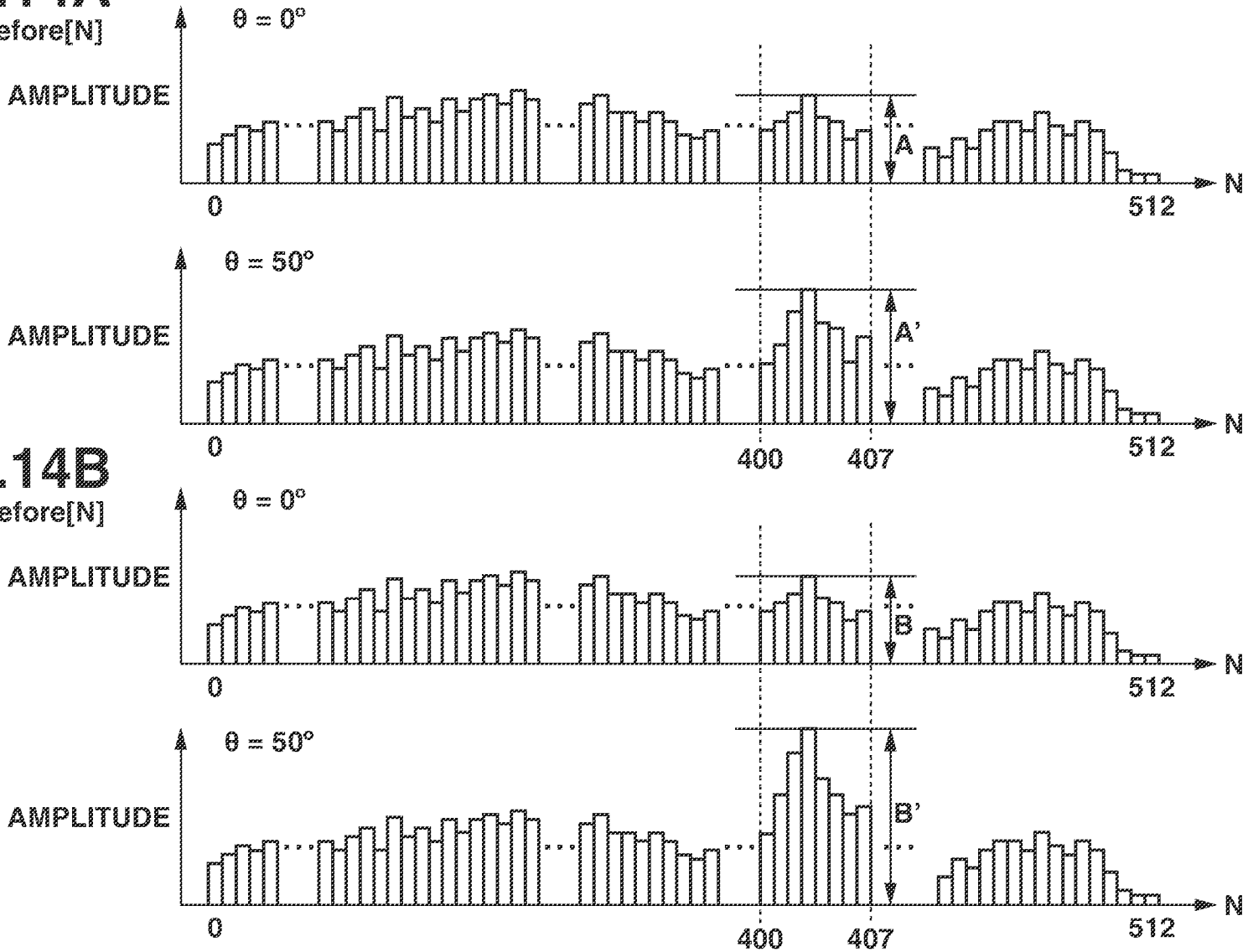
FIGS. 14A and 14B are diagrams illustrating changes of frequency spectra caused by a change of the orientation of the imaging apparatus in the second exemplary embodiment.

FIG. 14A illustrates Lch_Before obtained in a case where the angle θ, which indicates the orientation of the imaging apparatus 100, is 0° and 50°. In the second exemplary embodiment, the amplitudes of frequency spectra of Lch_Before[400] to Lch_Before[450] change. Here, in Lch_Before[400] to Lch_Before[450], the peak value of the amplitudes of the frequency spectrum in the case of the angle θ being 0° is assumed to be A, and the peak value of the amplitudes of the frequency spectrum in the case of the angle θ being 50° is assumed to be A'.

FIG. 14B illustrates Nch_Before obtained in a case where the angle θ, which indicates the orientation of the imaging apparatus 100, is 0° and 50°. In the second exemplary embodiment, the amplitudes of frequency spectra of Nch_Before[400] to Nch_Before[450] change. In the second exemplary embodiment, in Lch_Before and Nch_Before, the positions of frequency spectra where the amplitudes change are assumed to be the same. Here, in Nch_Before [400] to Nch_Before[450], the peak value of the amplitudes of the frequency spectrum in the case of the angle θ being 0° is assumed to be B, and the peak value of the amplitudes of the frequency spectrum in the case of the angle θ being 50° is assumed to be B'.

Here, the amount of change $|A'-A|$ of the peak values of the amplitudes of frequency spectra of Lch_Before and the amount of change $|B'-B|$ of the peak values of the amplitudes of frequency spectra of Nch_Before, which occur when the orientation of the imaging apparatus 100 has changed, are compared with each other. From FIGS. 14A and 14B, it can be read out that there is a relationship of $|B'-B|>|A'-A|$. This indicates that the amount of change of the sound volume of noise collected by the noise microphone 201*c* is larger than the amount of change of the sound volume of noise collected by the L microphone 201*a*. Therefore, in the second exemplary embodiment, to effectively reduce noise, the imaging apparatus 100 corrects noise parameters in a range at which the amplitudes of frequency spectra change according to the orientation of the imaging apparatus 100 changing.

FIG. 15 shows corrective noise parameters for respective pieces of orientation information about the imaging apparatus 100. In the second exemplary embodiment, an example in which the amplitudes of frequency spectra of Lch_Before, Rch_Before, and Nch_Before change in the range of N=400 to 450 is described. On the other hand, in the second exemplary embodiment, the amplitudes of frequency spectra of Lch_Before, Rch_Before, and Nch_Before are assumed to have a change sufficiently small to such a degree that it is not necessary to correct noise parameters, in the ranges of the other N. As shown in FIG. 15, only frequency spectra required to be targeted for correction are recorded as corrective noise parameters on the noise parameter recording unit 205. For example, in a case where the angle θ is 50°, the noise parameter selection unit 206 instructs the noise data generation unit 204 to use, together with the noise parameters determined to be used, corrective noise parameters for the range b. Furthermore, in a case where the angle θ is within the range c, the noise parameter selection unit 206 can determine that it is not necessary to correct noise parameters and does not need to issue an instruction concerning corrective noise parameters to the noise data generation unit 204.

Figure 16:
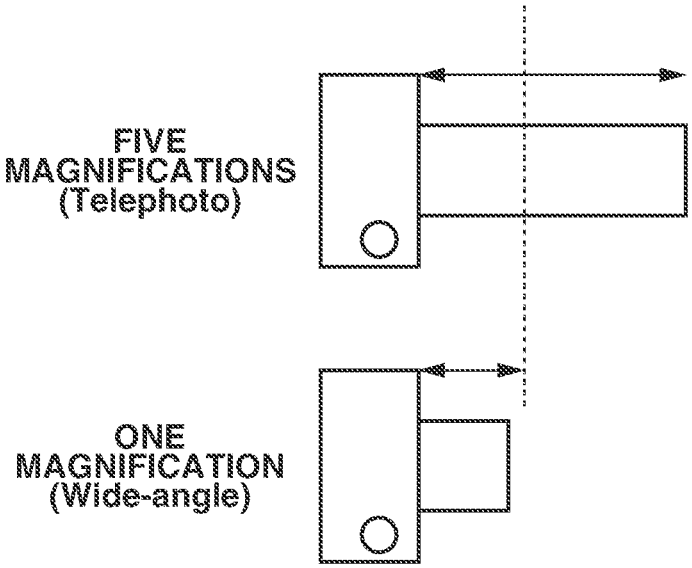
FIG. 16 is a diagram illustrating a comparison of lengths of a lens barrel in respective different zoom magnifications of the imaging apparatus in the second exemplary embodiment.

FIG. 16 illustrates a comparison in the length of the zoom lens in a case where different lens magnifications are set. As illustrated in FIG. 16, the zoom lens is able to change the focal length thereof by extension and contraction of the lens barrel and movement of the lens position. With this change, since the shape and structure of the lens are changed, the propagation path and propagation distance of noise from the motor serving as a noise source to each microphone are changed, so that frequency spectra of noise collected by each microphone change. In the second exemplary embodiment, the imaging apparatus 100 receives, via the lens control unit 102, a zoom magnification as lens information from the optical lens 300, thus acquiring the zoom magnification of the optical lens 300.

Figures 17A, 17B:
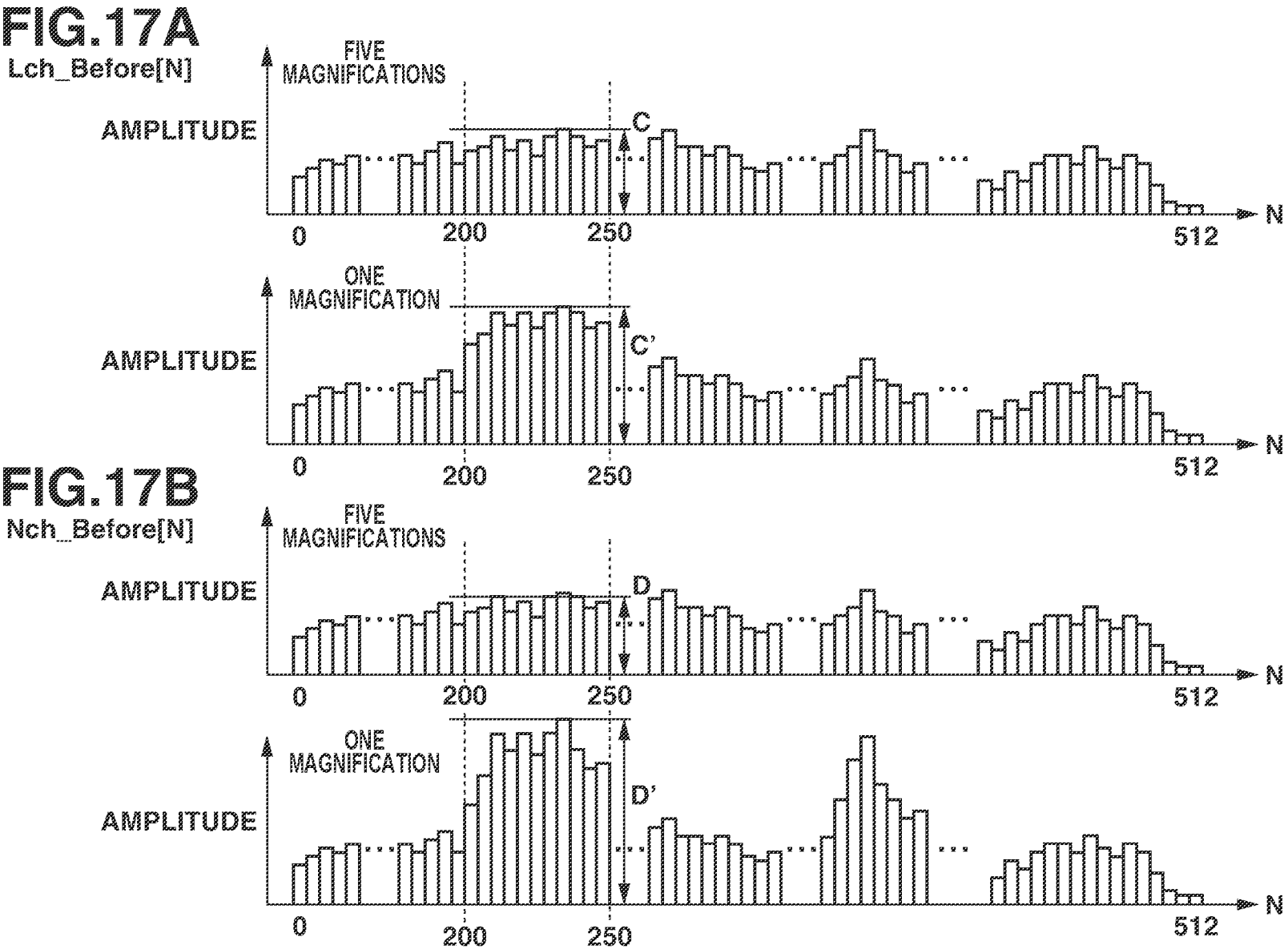
FIGS. 17A and 17B are diagrams illustrating changes of frequency spectra caused by a difference in the length of the imaging apparatus in the second exemplary embodiment.

FIG. 17A illustrates Lch_Before in a case where the zoom magnification of the optical lens 300 is one magnification and five magnifications. In the second exemplary embodiment, the amplitudes of frequency spectra of Lch_Before [200] to Lch_Before[250] change. Here, in Lch_Before [200] to Lch_Before[250], the peak value of the amplitudes of the frequency spectrum in the case of the zoom magnification being five magnifications is assumed to be C, and the peak value of the amplitudes of the frequency spectrum in the case of the zoom magnification being one magnification is assumed to be C'.

FIG. 17B illustrates Nch_Before in a case where the zoom magnification of the optical lens 300 is one magnification and five magnifications. In the second exemplary embodiment, the amplitudes of frequency spectra of Nch_Before [200] to Nch_Before[250] change. Here, in Nch_Before [200] to Nch_Before[250], the peak value of the amplitudes of the frequency spectrum in the case of the zoom magnification being five magnifications is assumed to be D, and the peak value of the amplitudes of the frequency spectrum in the case of the zoom magnification being one magnification is assumed to be D'.

Here, the amount of change $|C'-C|$ of the peak values of the amplitudes of frequency spectra of Lch_Before and the amount of change $|D'-D|$ of the peak values of the amplitudes of frequency spectra of Nch_Before, which occur when the zoom magnification of the optical lens 300 has changed, are compared with each other. From FIGS. 17A and 17B, it can be read out that there is a relationship of $|D'-D|>|C'-C|$. This indicates that the amount of change of the sound volume of noise collected by the noise microphone 201*c* is larger than the amount of change of the sound volume of noise collected by the L microphone 201*a*, as with a case where the orientation of the imaging apparatus 100 has changed. Therefore, in the second exemplary embodiment, to effectively reduce noise, the imaging apparatus 100 corrects noise parameters in a range at which the amplitudes of frequency spectra change according to the zoom magnification of the optical lens 300 changing.

FIG. 18 shows corrective noise parameters for respective zoom magnifications of the optical lens 300. In the second exemplary embodiment, an example in which the amplitudes of frequency spectra of Lch_Before, Rch_Before, and Nch_Before change in the range of N=200 to 250 is described. On the other hand, in the second exemplary embodiment, the amplitudes of frequency spectra of Lch_Before, Rch_Before, and Nch_Before are assumed to have a change sufficiently small to such a degree that it is not necessary to correct noise parameters, in the ranges of the other N. As shown in FIG. 18, only frequency spectra required to be targeted for correction are recorded as corrective noise parameters on the noise parameter recording unit 205. For example, in a case where the zoom magnification is 2.3 magnifications, the noise parameter selection unit 206 instructs the noise data generation unit 204 to use, together with the noise parameters determined to be used, corrective noise parameters for the zoom magnification being two to three magnifications. Furthermore, in a case where the zoom magnification is one magnification, the noise parameter selection unit 206 can determine that it is not necessary to correct noise parameters and does not need to issue an instruction concerning corrective noise parameters to the noise data generation unit 204.

Figure 19:
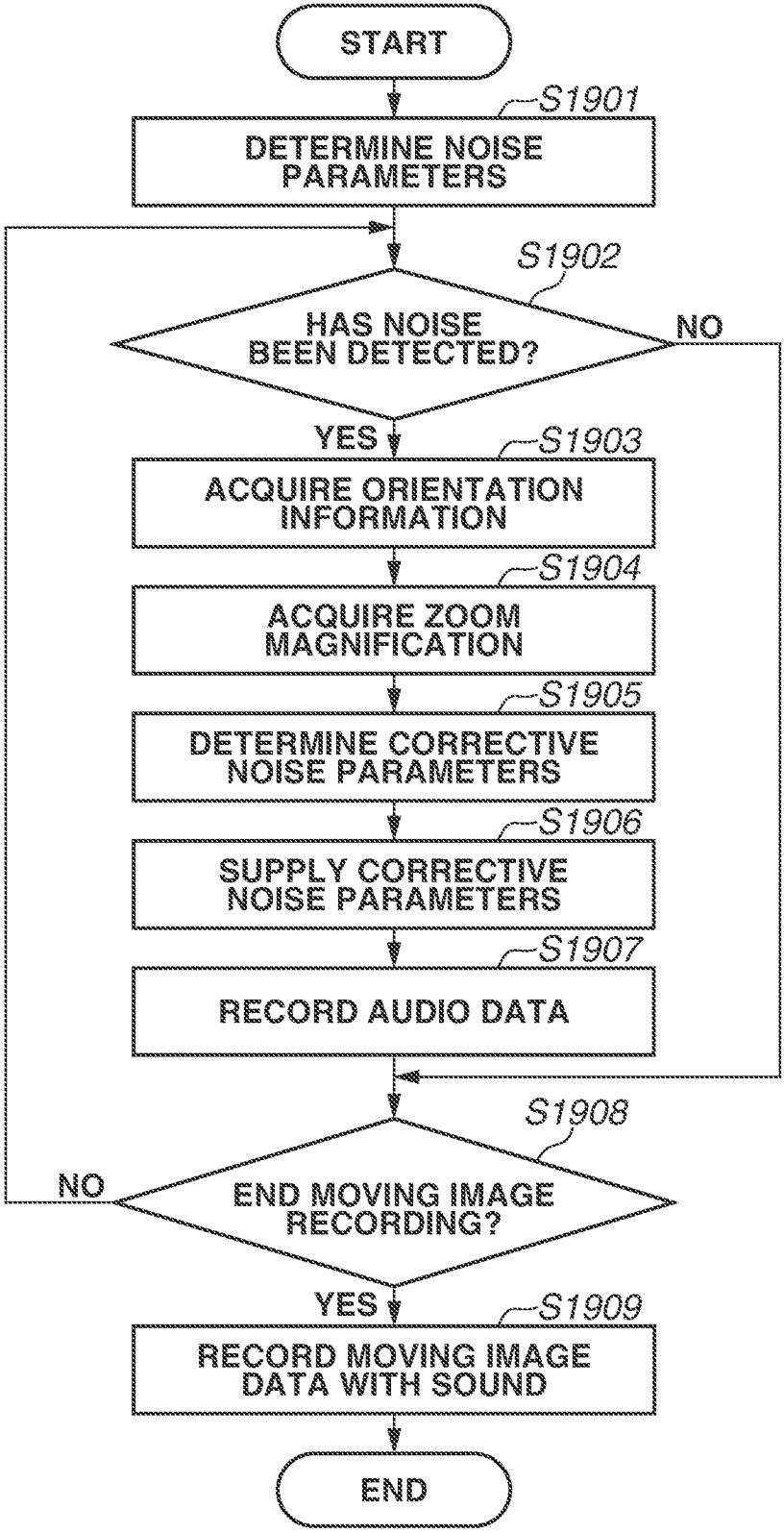
FIG. 19 is a flowchart illustrating processing which is performed by the imaging apparatus in the second exemplary embodiment.

In the following description, processing which is performed by the imaging apparatus 100 to correct noise parameters during moving image recording is described with reference to the flowchart of FIG. 19. The processing which is performed by the imaging apparatus 100 is started with a trigger of, for example, the release switch 61 being pressed by the user.

In step S1901, the noise parameter selection unit 206 determines to use the noise parameters for the optical lens 300 attached to the imaging apparatus 100.

In step S1902, the noise parameter selection unit 206 determines whether noise has been detected. If it is determined that noise has been detected (YES in step S1902), the noise parameter selection unit 206 advances the processing to step S1903. If it is determined that noise has not been detected (NO in step S1902), the noise parameter selection unit 206 advances the processing to step S1908.

In step S1903, the noise parameter selection unit 206 acquires orientation information about the imaging apparatus 100 from the information acquisition unit 103.

In step S1904, the noise parameter selection unit 206 acquires the zoom magnification of the optical lens 300 from the lens control unit 102.

In step S1905, the noise parameter selection unit 206 determines corrective noise parameters based on the orientation information acquired in step S1903 and the zoom magnification acquired in step S1904.

In step S1906, the noise parameter selection unit 206 instructs the noise data generation unit 204 to use the corrective noise parameters for use in noise reduction processing. Furthermore, the noise data generation unit 204 generates noise data with use of the noise parameters and the corrective parameters for the optical lens 300.

In step S1907, the audio input unit 104 records audio data subjected to noise reduction processing on the volatile memory 105. Furthermore, the control unit 111 records moving image data with sound on the recording medium 110 with use of the audio data recorded on the volatile memory 105.

In step S1908, the control unit 111 determines whether to end moving image recording. For example, in response to the release switch 61 being pressed, the control unit 111 determines to end moving image recording. On the other hand, in a case where the release switch 61 is not pressed, the control unit 111 determines not to end moving image recording. If it is determined to end moving image recording (YES in step S1908), the control unit 111 advances the processing to step S1909. If it is determined not to end moving image recording (NO in step S1209), the control unit 111 returns the processing to step S1902. In step S1909, the control unit 111 records moving image data with sound on the recording medium 110.

Thus far is the description of correction processing for noise parameters which is performed by the imaging apparatus 100.

In this way, correcting noise parameters during moving image recording enables performing effective noise reduction processing.

Furthermore, in the second exemplary embodiment, an example in which the amplitudes of frequency spectra of Lch_Before[200] to Lch_Before[250] and Nch_Before[200] to Nch_Before[250] change according to the orientation of the imaging apparatus 100 has been described. However, the positions of frequency spectra which change according to the orientation of the imaging apparatus 100 depend on, for example, the shape and structure of each lens, and, therefore, differ with types of the optical lens 300. Similarly, since the positions of frequency spectra which change according to the zoom magnification of the optical lens 300 depend on, for example, the shape and structure of each lens, the positions of frequency spectra differ with types of the optical lens 300. Thus, the corrective noise parameters become noise parameters in positions other than those of frequency spectra illustrated in the second exemplary embodiment, according to the type of the optical lens 300.

Furthermore, besides the above configuration, the imaging apparatus 100 can be configured to change noise parameters according to whether the imaging apparatus 100 is being gripped with the hand of the user or is being fixed to, for example, a tripod. This correction is performed because frequency spectra of noise input to each microphone differ due to a difference in, for example, transfer function between a state in which the imaging apparatus 100 is being gripped with the hand of the user and a state in which the imaging apparatus 100 is being fixed.

Moreover, in addition to the above configuration, the imaging apparatus 100 can be configured to detect a state of the imaging apparatus 100 which affects frequency spectra of noise collected by each microphone and correct noise parameters according to a result of detection. Specifically, the imaging apparatus 100 detects a state concerning the audio processing apparatus which affects a transfer path or transfer function of sound from a noise source to each microphone, and corrects noise parameters according to the detected state.

Figure 20:
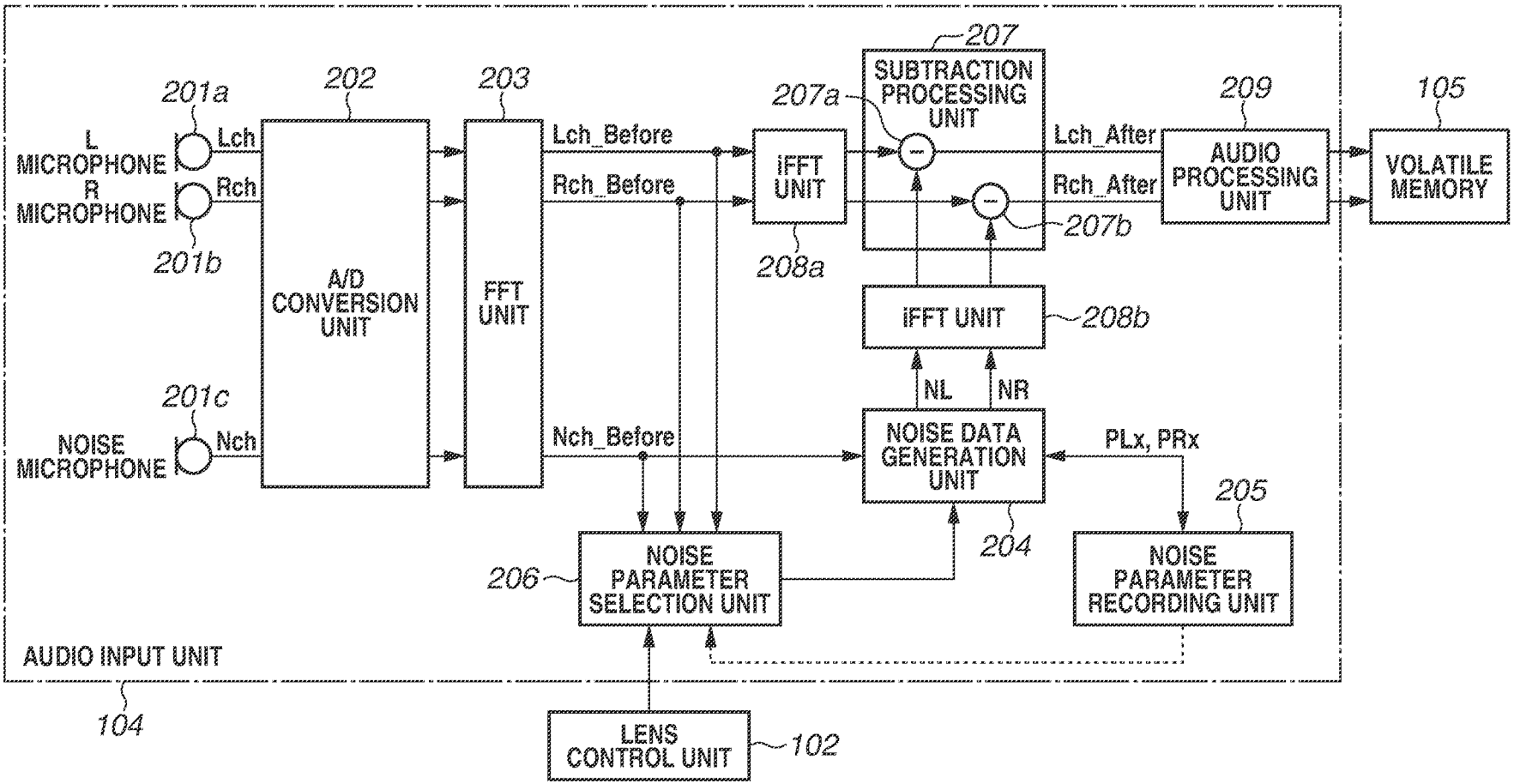
FIG. 20 is a block diagram illustrating a configuration of an audio input unit of the imaging apparatus in a third exemplary embodiment.

Here, FIG. 20 is a block diagram illustrating a configuration example of an audio input unit 104 in a third exemplary embodiment. Portions different from the configuration of the audio input unit 104 illustrated in FIG. 3 are the subtraction processing unit 207 and the iFFT unit 208. Here, the description of processing portions similar to those illustrated in FIG. 3 are omitted.

An iFFT unit 208*a* performs inverse fast Fourier transform of each of Lch_Before and Rch_Before input from the FFT unit 203, thus converting a frequency-domain digital audio signal into a time-domain digital audio signal. Moreover, an iFFT unit 208*b* performs inverse fast Fourier transform of each of NL and NR input from the noise data generation unit 204, thus converting a frequency-domain digital audio signal into a time-domain digital audio signal.

The subtraction processing unit 207 subtracts a digital audio signal input from the iFFT unit 208*b* from a digital audio signal input from the iFFT unit 208*a*. Subtraction processing which is performed by the subtraction processing unit 207 is a waveform subtraction method which performs subtraction on a digital audio signal in a time region.

The waveform subtraction method in the third exemplary embodiment can be applied instead of the spectral subtraction method in the first exemplary embodiment or the second exemplary embodiment.

Furthermore, when performing waveform subtraction, the imaging apparatus 100 can be configured to also record, as noise parameters, parameters concerning the phase of a digital audio signal.

Other Embodiments

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random access memory (RAM), a read-only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Applications No. 2020-143205 filed Aug. 27, 2020, No. 2020-143203 filed Aug. 27, 2020, and No. 2020-161435 filed Sep. 25, 2020, which are hereby incorporated by reference herein in their entirety.

What is claimed is:

1. An audio processing apparatus to which a lens device including a noise source is attached, comprising:

a first microphone that acquires ambient sound;

a second microphone that acquires sound occurring from the noise source of the lens device attached to the audio processing apparatus;

a central processing unit (CPU); and a memory storing a program that, when executed by the CPU, causes the audio processing apparatus to function as:

a first conversion unit configured to perform Fourier transform of an audio signal output from the first microphone and output a first frequency-domain audio signal;

a second conversion unit configured to perform Fourier transform of an audio signal output from the second microphone and output a second frequency-domain audio signal;

a generation unit configured to generate noise data by performing a calculation on the second frequency-domain audio signal and a parameter corresponding to a type of the lens device attached to the audio processing apparatus;

a reducing unit configured to reduce the noise of the noise source included in the first frequency-domain audio signal in accordance with the noise data generated by the generation unit and output a noise reduced frequency-domain audio signal;

a third conversion unit configured to perform inverse Fourier transform of the noise reduced frequency-domain audio signal output from the reducing unit and output a noise reduced time-domain audio signal.

2. The audio processing apparatus according to claim 1, wherein the generation unit determines the parameter for use in the calculation from among a plurality of parameters each corresponding to a plurality of types of lens devices based on information of the type of the lens device attached to the audio processing apparatus.

3. The audio processing apparatus according to claim 1, wherein the program, when executed by the CPU, further causes the audio processing apparatus to function as:

a detection unit configured to detect whether the lens device has been replaced; and a determination unit configured to, in response to the detection unit detecting that the lens device has been replaced, determine the parameter corresponding to the type of the lens device attached to the audio processing apparatus by replacement of the lens device from among a plurality of parameters each corresponding to a plurality of types of lens devices as the parameter to be used in the calculation by the generation unit.

4. The audio processing apparatus according to claim 3, wherein the plurality of parameters are recorded on a recording unit.

5. The audio processing apparatus according to claim 4, wherein, in a case where the parameter corresponding to the type of the lens device attached to the audio processing apparatus is not currently recorded on the recording unit, the determination unit determines a parameter having a default value as the parameter for use in the calculation by the generation unit.

6. The audio processing apparatus according to claim 1, wherein the noise source is a motor, and a type of the motor included in the lens device differs with the type of the lens device.

7. The audio processing apparatus according to claim 1, wherein the type of the lens device is a model number of the lens.

8. A control method of an audio processing apparatus to which a lens device including a noise source is attached, the audio processing apparatus having a first microphone that acquires ambient sound, and a second microphone that acquires sound occurring from the noise source, the control method comprising:

performing Fourier transform of an audio signal output from the first microphone and outputting a first frequency-domain audio signal;

performing Fourier transform of an audio signal output from the second microphone and outputting a second frequency-domain audio signal;

generating noise data by performing a calculation on the second frequency-domain audio signal and a parameter corresponding to a type of lens device attached to the audio processing apparatus;

reducing the noise of the noise source included in the first frequency-domain audio signal in accordance with the noise data generated by the generating and outputting a noise reduced frequency-domain audio signal; and performing inverse Fourier transform of the noise reduced frequency-domain audio signal and outputting a noise reduced time-domain audio signal.

9. A non-transitory computer-readable storage medium storing computer-executable instructions that, when executed by a computer, cause the computer to perform a control method of an audio processing apparatus to which a lens device including a noise source is attached, the audio processing apparatus having a first microphone that acquires ambient sound, and a second microphone that acquires sound occurring from the noise source, the control method comprising:

performing Fourier transform of an audio signal output from the first microphone and outputting a first frequency-domain audio signal;

performing Fourier transform of an audio signal output from the second microphone and outputting a second frequency-domain audio signal;

generate noise data by performing a calculation on the second frequency-domain audio signal and a parameter corresponding to a type of the lens device attached to the audio processing apparatus;

reducing the noise of the noise source included in the first frequency-domain audio signal in accordance with the noise data generated by the generating and outputting a noise reduced frequency-domain audio signal; and performing inverse Fourier transform of the noise reduced frequency-domain audio signal and outputting a noise reduced time-domain audio signal.

10. An audio processing apparatus comprising:

a first microphone that acquires ambient sound;

a second microphone that acquires sound occurring from a noise source;

a central processing unit (CPU); and a memory storing a program that, when executed by the CPU, causes the audio processing apparatus to function as:

a detection unit configured to detect a state concerning the audio processing apparatus;

a first conversion unit configured to perform Fourier transform of an audio signal output from the first microphone and output a first frequency-domain audio signal;

a second conversion unit configured to perform Fourier transform of an audio signal output from the second microphone and output a second frequency-domain audio signal;

a generation unit configured to generate noise data by performing a calculation on the second frequency-domain audio signal and a noise parameter corresponding to the noise source;

a reducing unit configured to reduce the noise of the noise source included in the first frequency-domain audio signal in accordance with the noise data generated by the generation unit and output a noise reduced frequency-domain audio signal; and a third conversion unit configured to perform inverse Fourier transform of the noise reduced frequency-domain audio signal output from the noise reducing unit and output a noise reduced time-domain audio signal, wherein the generation unit corrects the noise parameter according to the state concerning the audio processing apparatus detected by the detection unit.

11. The audio processing apparatus according to claim 10, wherein the detection unit detects orientation of the audio processing apparatus, and wherein the generation unit corrects the noise parameter according to the orientation of the audio processing apparatus detected by the detection unit.

12. The audio processing apparatus according to claim 10, wherein a lens device including the noise source is attached to the audio processing apparatus, wherein the detection unit detects information concerned with a length of a lens barrel of the lens device attached to the audio processing apparatus as information concerning the audio processing apparatus, and wherein the generation unit corrects the noise parameter according to the information concerned with the length of the lens barrel of the lens device detected by the detection unit.

13. The audio processing apparatus according to claim 12, wherein the information concerned with the length of the lens barrel of the lens includes a zoom magnification of the lens.

14. The audio processing apparatus according to claim 10, wherein the generation unit corrects the noise parameter in at least a part of frequency spectra.

15. The audio processing apparatus according to claim 10, wherein the generation unit detects whether noise is occurring from the noise source, wherein, in a case where it has been detected that noise is occurring from the noise source, the generation unit corrects the noise parameter, and wherein, in a case where it has not been detected that noise is occurring from the noise source, the generation unit does not correct the noise parameter.

16. The audio processing apparatus according to claim 10, wherein the generation unit determines a corrective noise parameter corresponding to the state detected by the detection unit from among a plurality of corrective noise parameters and corrects the noise parameter in accordance with the determined corrective noise parameter.

17. The audio processing apparatus according to claim 16, wherein a device including the noise source is attached to the audio processing apparatus, a plurality of noise parameters corresponding to a plurality of types of devices and the plurality of corrective noise parameters are recorded on a recording unit, and the generation unit determines the noise parameter corresponding to the device attached to the audio processing apparatus from among the plurality of noise parameters recorded on the recording unit.

18. The audio processing apparatus according to claim 17, wherein the first microphone includes a plurality of microphones, and wherein the noise parameter for each microphone included in the first microphone is recorded on the recoding unit.

19. A control method for an audio processing apparatus including a first microphone that acquires ambient sound, and a second microphone that acquires sound occurring from a noise source, the control method comprising:

detecting a state concerning the audio processing apparatus;

performing Fourier transform of an audio signal output from the first microphone and output a first frequency-domain audio signal;

performing Fourier transform of an audio signal output from the second microphone and output a second frequency-domain audio signal;

generating noise data by performing a calculation on the second frequency-domain audio signal and a noise parameter corresponding to the noise source;

reducing the noise of the noise source included in the first frequency-domain audio signal in accordance with the noise data generated by the generating and output a noise reduced frequency-domain audio signal; and performing inverse Fourier transform of the noise reduced frequency-domain audio signal and outputting a noise reduced time-domain audio signal, wherein, in generating the noise data, the noise parameter is corrected according to the detected state concerning the audio processing apparatus.

20. A non-transitory computer-readable storage medium storing computer-executable instructions that, when executed by a computer, cause the computer to perform a control method for an audio processing apparatus including a first microphone that acquires ambient sound, and a second microphone that acquires sound occurring from a noise source, the control method comprising:

detecting a state concerning the audio processing apparatus;

performing Fourier transform of an audio signal output from the first microphone and output a first frequency-domain audio signal;

performing Fourier transform of an audio signal output from the second microphone and output a second frequency-domain audio signal;

generating noise data by performing a calculation on the second frequency-domain audio signal and a noise parameter corresponding to the noise source;

reducing the noise of the noise source included in the first frequency-domain audio signal in accordance with the noise data generated by the generating and output a noise reduced frequency-domain audio signal; and performing inverse Fourier transform of the noise reduced frequency-domain audio signal and outputting a noise reduced time-domain audio signal, wherein, in generating the noise data, the noise parameter is corrected according to the detected state concerning the audio processing apparatus.

* * * * *